US010473410B2

(12) United States Patent
Jaikumar et al.

(10) Patent No.: US 10,473,410 B2
(45) Date of Patent: Nov. 12, 2019

(54) POOL BOILING ENHANCEMENT WITH FEEDER CHANNELS SUPPLYING LIQUID TO NUCLEATING REGIONS

(71) Applicants: Arvind Jaikumar, Rochester, NY (US); Satish G. Kandlikar, Rochester, NY (US)

(72) Inventors: Arvind Jaikumar, Rochester, NY (US); Satish G. Kandlikar, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 15/354,500

(22) Filed: Nov. 17, 2016

(65) Prior Publication Data

US 2017/0138678 A1 May 18, 2017

Related U.S. Application Data

(60) Provisional application No. 62/256,286, filed on Nov. 17, 2015.

(51) Int. Cl.

| | |
|---|---|
| ***F28F 13/18*** | (2006.01) |
| ***F28F 3/12*** | (2006.01) |
| *F28D 21/00* | (2006.01) |

(52) U.S. Cl.

CPC ..... *F28F 13/187* (2013.01); *F28F 3/12* (2013.01); *F28D 2021/0028* (2013.01); *F28F 2260/02* (2013.01)

(58) Field of Classification Search

CPC ..... F28F 13/187; F28F 3/12; F28F 2200/005; F28F 2260/02; F28D 21/0017; F28D 2021/0028

See application file for complete search history.

(56) References Cited

U.S. PATENT DOCUMENTS 4,733,698 A * 3/1988 Sato ..... F28F 1/40 138/38
5,259,448 A * 11/1993 Masukawa ..... B21C 37/202 165/133

(Continued)

FOREIGN PATENT DOCUMENTS

| | | |
|---|---|---|
| JP | S5946490 | 3/1984 |
| WO | 2015095356 A1 | 6/2015 |

OTHER PUBLICATIONS

Betz, Amy Rachel, Xu, Jie, Qiu, Huihe and Attinger, Daniel. Do surfaces with mixed hydrophilic and hydrophobic areas enhance pool boiling? Applied Physics Letters, 97, 141909 (2010).

(Continued)

*Primary Examiner* — Claire E Rojohn, III

(74) *Attorney, Agent, or Firm* — Bond, Schoeneck & King, PLLC; Joseph Noto

(57) ABSTRACT

A boiling heat transfer unit includes a substrate having a heat exchange region including a plurality of nucleating regions adjacent to feeder channels, wherein adjacent nucleating regions are separated by the feeder channels at a distance whereby vapor formed in the nucleating regions is moved away from the nucleating regions influencing liquid flow through the feeder channels towards the nucleating regions thereby establishing continuous self-sustaining separate vapor and liquid pathways increasing heat transfer due to developing region heat transfer in the feeder channels and enhancing overall boiling performance.

6 Claims, 19 Drawing Sheets

(56) References Cited

U.S. PATENT DOCUMENTS 5,814,392 A * 9/1998 You ..... B05D 5/02 427/386
6,067,712 A * 5/2000 Randlett ..... F28F 1/26 165/109.1
6,182,743 B1 * 2/2001 Bennett ..... F28F 1/40 165/133
6,662,860 B2 * 12/2003 Iwamoto ..... F28F 1/32 138/38
6,863,118 B1 * 3/2005 Wang ..... F28D 15/0233 165/104.21
7,048,043 B2 * 5/2006 Leterrible ..... F28F 1/40 165/184
7,267,166 B2 * 9/2007 Leterrible ..... F28F 1/40 138/38
7,311,137 B2 * 12/2007 Thors ..... B21C 37/20 165/133
8,091,615 B2 * 1/2012 Houfuku ..... F28F 1/40 165/133
8,281,850 B2 * 10/2012 Beutler ..... F28F 1/36 165/133
8,753,752 B2 * 6/2014 Fujii ..... B21C 37/02 165/133
8,875,780 B2 * 11/2014 Smith ..... F28F 1/325 165/133
9,207,025 B2 * 12/2015 Varanasi ..... B05D 7/22
10,082,349 B2 * 9/2018 Wang ..... F28F 13/187
2005/0211418 A1 9/2005 Kenny et al.
2005/0279491 A1 * 12/2005 Thome ..... F28D 15/0266 165/272
2006/0142401 A1 * 6/2006 Tonkovich ..... B01B 1/005 518/726
2012/0097373 A1 * 4/2012 Kandlikar ..... F28D 15/0266 165/104.29
2012/0285664 A1 * 11/2012 Kandlikar ..... B01D 1/00 165/104.29
2013/0027878 A1 * 1/2013 Campbell ..... H05K 7/2029 361/694
2017/0138678 A1 * 5/2017 Jaikumar ..... F28F 13/187
2017/0176114 A1 * 6/2017 Kandlikar ..... F28F 13/187

OTHER PUBLICATIONS

Cooke, Dwight and Kandlikar, Satish G. Effect of open microchannel geometry on pool boiling enhancement. International Journal of Heat and Mass Transfer, 55 (2012) 1004-1013.

O'Hanley, Harry, Coyle, Carolyn, Buongiorno, Jacopo, McKrell, Tom, Hu, Lin-Wen, Rubner, Michael, and Cohen, Robert. Separate Effects of Surface Roughness, Wettability and Porosity on the Boiling Critical Heat Flux. Applied Physics Letters 103, No. 2 (2013): 024102.

International Search Report Form PCT/ISA/220, International Application No. PCT/US2016/062521, pp. 1-8, dated Jan. 23, 2017.

European Extended Search Report dated Jun. 14, 2019, for European Application No. 16867133.7; 7 pages.

* cited by examiner

POOL BOILING ENHANCEMENT WITH FEEDER CHANNELS SUPPLYING LIQUID TO NUCLEATING REGIONS

CROSS REFERENCE

This application claims the benefit of the filing date of U.S. Provisional Patent Application Ser. No. 62/256,286, filed Nov. 17, 2015, which is hereby incorporated by reference in its entirety.

This invention was made with government support under grant number 1335927 awarded by National Science Foundation. The government certain rights in this invention.

FIELD

The current disclosure relates to enhanced pool boiling microstructure with nucleating regions (NRs) bounded by feeder channels (FCs) such that the nucleating regions are separated by a sufficient distance to provide separate liquid and vapor pathways, which distance is typically within a range of the bubble departure diameter.

BACKGROUND

Passive boiling heat transfer enhancement offers attractive cooling possibilities in high powered electronic systems. The present miniaturization trend in microelectronic devices and MEMS technology demands effective thermal management. Pool boiling has long served as a means to dissipate large heat flux over a small footprint which has led to development of enhanced heat transfer surfaces for a wide range of applications for example, power generation, refrigeration, air conditioning, petrochemical, chemical, pharmaceutical and process industries. The main objective of enhanced surfaces is to reduce wall superheat and increase critical heat flux which offers enhanced performance over a wide operating range. Improvement in heat transfer will result in lower sizes of equipment being used, higher efficiency and reduced consumption of fuels. A typical pool boiling performance is characterized by the plot of heat flux versus all superheat. The degree by which the curve shifts to the left and also higher critical heat flux (CHF) value depicts the extent of enhancement compared to a flat surface. This heat transfer can be enhanced either by using active devices like ultrasonic vibrations, electrostatic fields etc., or passive techniques like porous/microporous surfaces, structured surfaces like open microchannels (microgrooves), finned or knurled surfaces, and the like.

SUMMARY

In accordance with one aspect of the disclosure, there is provided a boiling heat transfer unit including a substrate having a heat exchange region including a plurality of nucleating regions adjacent to feeder channels, wherein adjacent nucleating regions are separated by the feeder channels at a distance of between about 1 mm to about 10 mm, wherein the width of the nucleating region is a distance within a range from about 5 μm to about 4 mm, the width of the feeder channel is a distance within a range from about 5 μm to about 4 mm, the depth of the feeder channel is from above 0 mm tea about 10 mm, whereby vapor formed in the nucleating regions is moved away from the nucleating regions influencing liquid flow through the feeder channels towards the adjacent nucleating region thereby establishing continuous self-sustaining separate vapor and liquid flow pathways increasing heat transfer due to developing region heat, transfer in the feeder channels and enhancing overall boiling performance. The thickness of the walls separating individual FCs, also referred to as fin width is from about 100 μm to about 2 mm. These dimensions are determined from structural integrity, fin efficiency and overall hydrodynamic and thermal field considerations.

In accordance with another aspect of the disclosure, there is provided a boiling heat transfer unit including a substrate having a heat exchange region including a plurality of nucleating regions adjacent to feeder channels, wherein adjacent nucleating regions are separated by the feeder channels at a distance of between about 50 percent to about 200 percent of an estimation of the departure bubble diameter, whereby vapor formed in the nucleating regions is moved away from the nucleating regions influencing liquid flow through the feeder channels towards the adjacent nucleating region thereby establishing continuous self-sustaining separate vapor and liquid flow pathways increasing heat transfer due to developing region heat transfer in the feeder channels and enhancing overall boiling performance.

In accordance with another aspect of the disclosure, there is provided a boiling heat transfer unit including a substrate having a heat exchange region including a plurality of nucleating regions adjacent to feeder channels, wherein adjacent nucleating regions are separated by the feeder channels at a distance whereby vapor formed into bubbles in the nucleating regions is moved away from the nucleating regions influencing liquid flow through the feeder channels towards the nucleating regions thereby establishing continuous self-sustaining separate vapor and liquid pathways increasing heat transfer due to developing region heat transfer in the feeder channels and enhancing overall boiling performance.

These and other aspects of the present disclosure will become apparent upon a review of the following detailed description and the claims appended thereto.

DETAILED DESCRIPTION

Figure 1A:
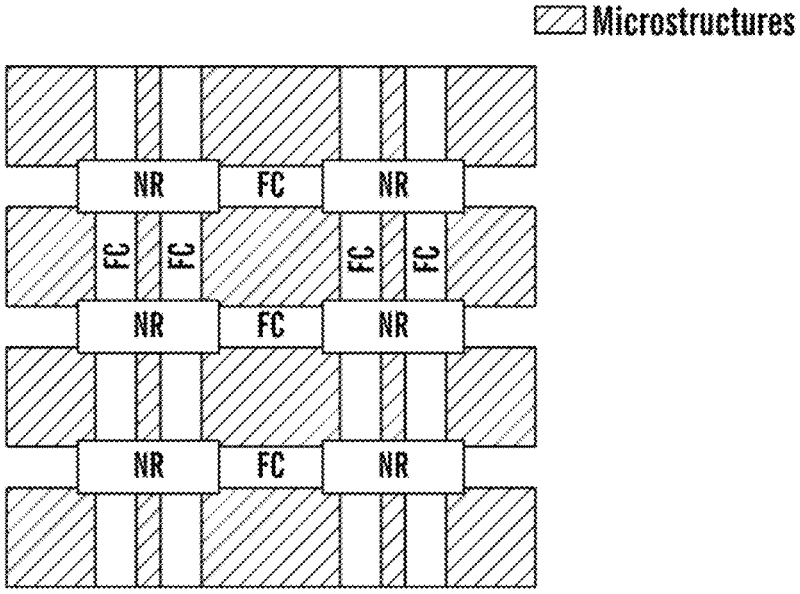
FIG. 1 is a drawing of various embodiments incorporating the Nucleating Regions with Feeder Channels (NRFC) configuration.
Figure 1B:
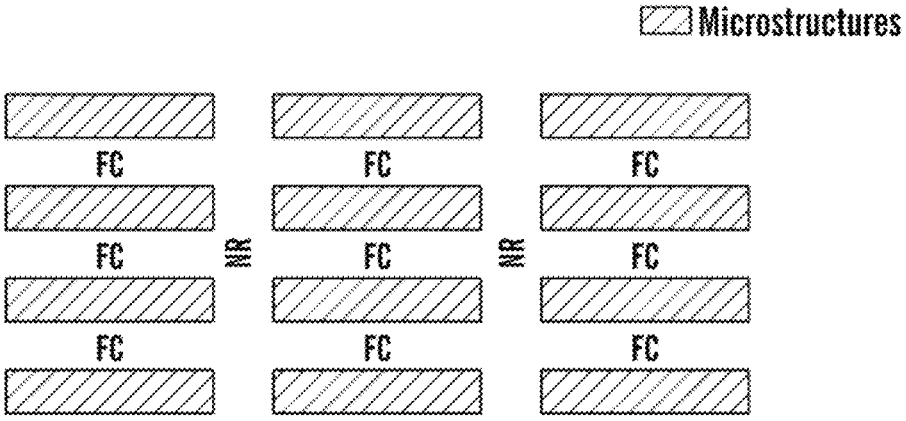
Figure 1C:
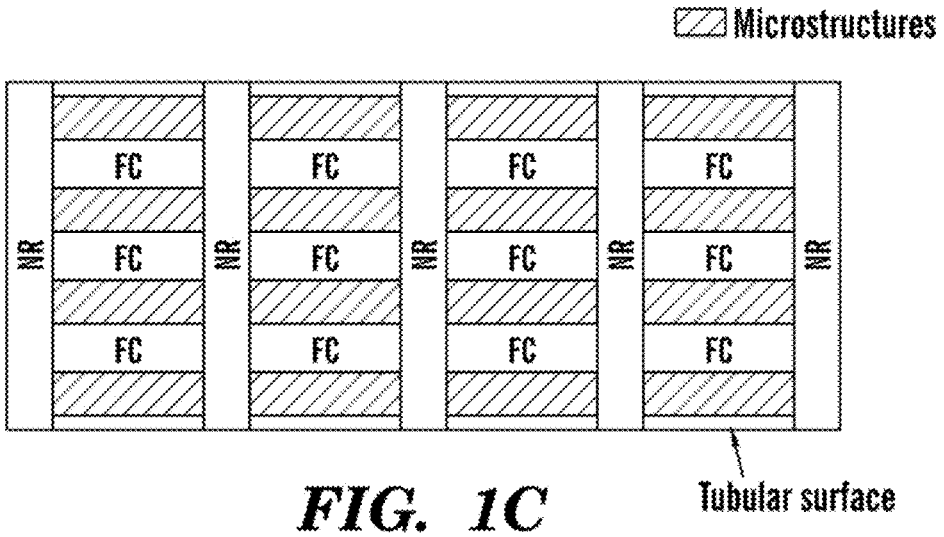
Figure 1D:
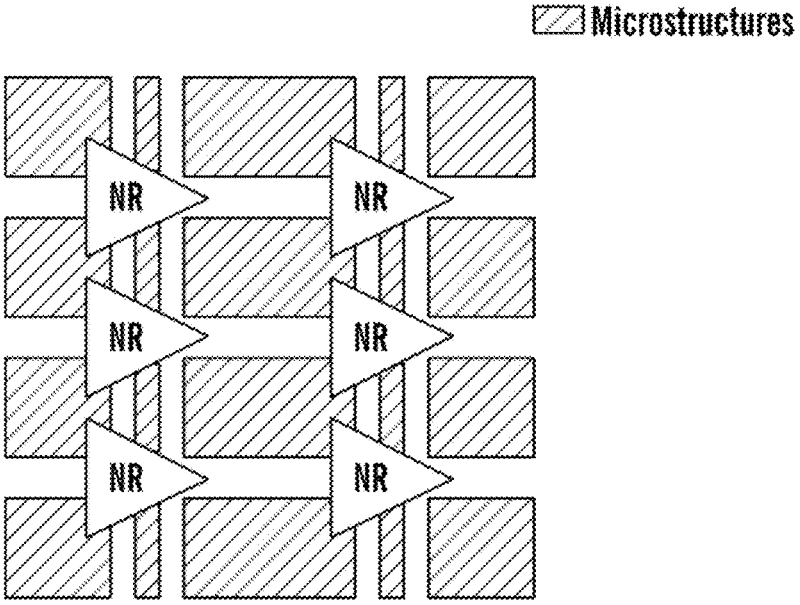
Figure 1E:
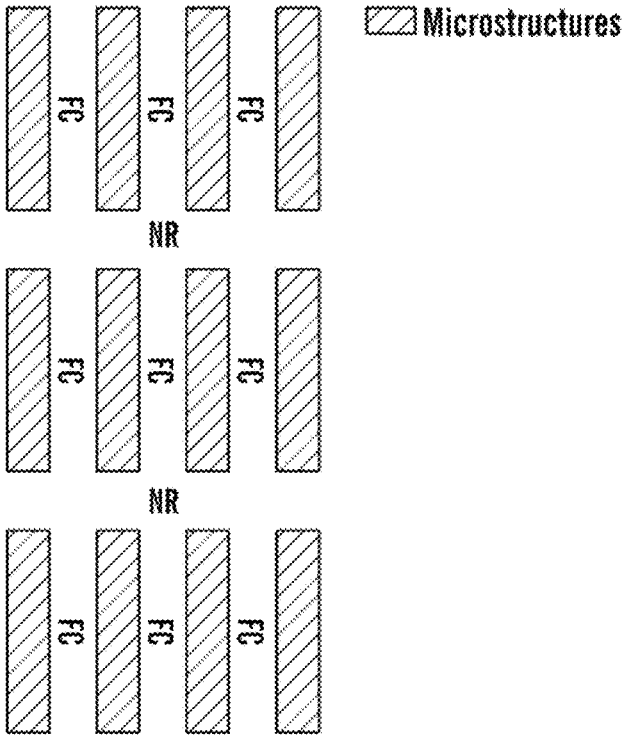
Figure 1F:
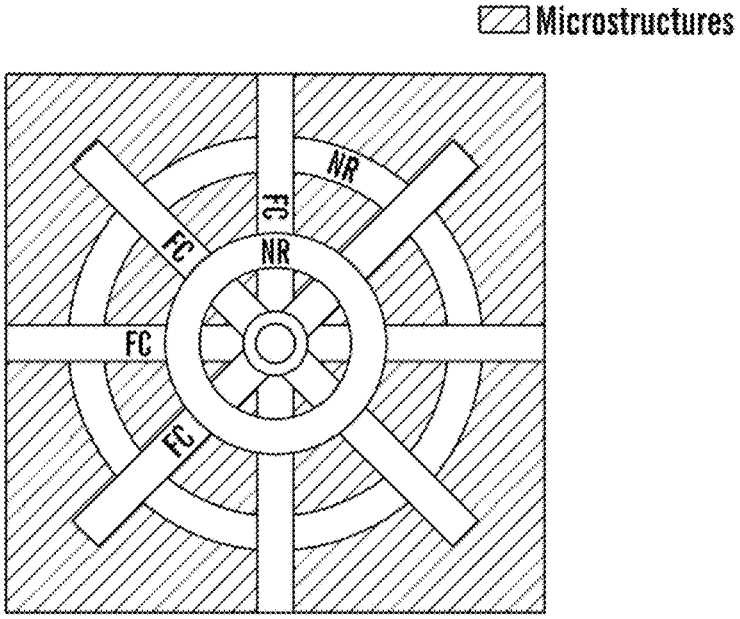

The present disclosure relates to a heat transfer system including a substrate for liquid pool boiling. The substrate can be any suitable material for boiling applications, including copper, copper alloy, aluminum, steel, nickel, titanium, alloys, silicon, germanium, or a composite of different materials including films. The heat transfer system in accordance with the present disclosure includes a substrate for liquid pool boiling having a heat exchange region in which heat is transferred between the substrate and a fluid in communication with the substrate. The substrate can include a planar surface, curved surface, tubular surface, sloping surface or combinations thereof.

A boiling system includes a heat exchange region in contact with the boiling liquid. The heat exchange region includes cavities at which nucleation occurs in the liquid, preferentially when the surface temperature is greater than the saturation temperature of the liquid. In an embodiment this is accomplished by selectively suppressing nucleating cavities by returning liquid either flowing along the surface of the substrate or impinging on the surface of the substrate from the bulk liquid. Nucleating regions can be clearly defined by adding nucleating cavities in the selected regions. The current disclosure describes a heat exchange region having a network of nucleating regions and adjacent feeder channels in contact with the boiling liquid.

At the beginning of the boiling process, bubbles nucleate randomly over the heat exchange region before a spatial ordering of liquid and vapor prevails for the remainder of the operating range. The continuous self-sustained spatial ordering of separate liquid and vapor flow paths is reached when the preferential nucleation occurs through cavities located on the nucleating region through which vapor is removed, while liquid feeder channels adjacent the nucleating region promote liquid transport towards the nucleating region. The liquid flow within individual FCs provides a cooling effect. This cooling effect combined with the liquid velocity suppresses nucleation in the FCs. The spatial ordering is promoted by the efficacy of the heat exchange region having a designed network of nucleating regions and adjacent feeder channels to establish continuous and self-sustaining separate liquid and vapor pathways.

As vapor bubbles depart from the nucleating regions vapor pathways are created, liquid is returned to these regions along the heated substrate surface creating liquid pathways. In one embodiment, a nucleating region is designed as a lengthwise strip having feeder channels on each side along the length of the nucleating region. As the liquid flows over the substrate returning liquid enters the feeder channels and flows towards the adjacent nucleating region from the sides of the lengthwise nucleating region strip.

The system is designed such that the nucleating region has nucleation cavities which turn superheated liquid contacting this region into vapor. The nucleated vapor bubbles move into the nucleating regions and depart from the surface. The departed bubbles create liquid motion over the adjacent regions. The vapor generation rate increases at higher heat fluxes which amplify the effects due to increased liquid velocity created over the adjacent regions.

A feeder channel is defined as a region on the substrate made up of walls or fin-like structures capable of having liquid flowing through the open feeder channel flow area formed by them. The feeder channels direct the liquid flow towards the nucleating region during pool boiling. The feeder channels in an embodiment are open microchannels. Feeder channels may take other forms, such, as strip fins, offset strip fins of different cross-sections, and the like. The returning liquid flowing in feeder channels experiences developing hydrodynamic and thermal boundary layers. The short flow distances in such developing regions leads to enhancement in heat transfer. This enhancement may be higher than the enhancement provided by the growth and departure of bubbles in their immediate vicinity sometimes referred to as an influence region. This presents an enhancement scenario wherein the CHF is increased as compared to the CHF obtained on a plain surface. Surfaces incorporating microstructures described herein are also able to enhance flow boiling heat transfer when the flow does not adversely affect formation of continuous self-sustained separate liquid and vapor pathways.

The specific geometrical arrangement of nucleating regions and adjacent feeder channels leads to nucleation over a substantial portion of the substrate surface at the start-up or low heat fluxes closer to the onset of nucleate boiling conditions. As the heat flux increases the returning liquid through the feeder channels suppresses nucleation in the feeder channel regions. The nucleating region produces bubbles from cavities located in these regions. The base of the feeder channels adjoining the nucleating region provides additional cavities due to typical manufacturing processes. Such cavities occur naturally at corners. Nucleation cavities may also be intentionally introduced in the nucleating regions by using techniques such as but not limited to etching, porous coating, laser drilling, mechanical abrasion, and the like. Some of the bubbles which may be generated in the feeder regions experience the flow of returning liquid which is cooler than the liquid adjacent to the bubble. This flow suppresses bubble growth and leads to suppression of nucleation in the feeder channel regions. A few bubbles may still grow in the feeder channel regions due to local variations in the thermal field. However, the overall effect of such bubbles may not be significant in reducing the performance. The introduction of returning liquid can cause enhancement of heat transfer due to one of the different effects such as jet impingement, flow through open microchannels, flow through an array of microscale features, developing flow through the feeder channels, and disruption of hydrodynamic and thermal boundary layers in the liquid flow through the feeder channels by additional microscale features.

In an embodiment, a heat transfer system includes a heat transfer substrate having a heat exchange region and enhancement microstructures including a nucleating region (NR) and feeder channels (FC) such that the NR channels are bounded by feeder channels. The corner regions at the intersection of FCs and NR channels serve as nucleation sites and the NR channels serve as preferential vapor removal pathways with subsequent liquid addition through the FCs.

The FCs can be fabricated by conventional milling machine, Computer Numerical Control (CNC) machining, embossing technique, powder compaction, bonding, electrical discharge machining (EDM), microfabrication techniques such as deep reactive ion etching (DRIE), laser ablation, and the like, or any other additive or subtractive technique.

The FCs can be planar, curved, radial, sloping or any such configuration that promotes liquid transport towards the NR channels.

The FCs can be coated further with micro/nano structures that promote liquid transport alone. Short nanowires promote wicking and enhance liquid transport, which is desirable, whereas tall nanowires result in bunching and act as nucleation sites, which is undesirable for FCs. The selection of micro/nano structures when used is also important to maintain bubble departure diameters close to the desirable range obtained through experimental observations or theoretical calculations such as specified in equation (1).

NR channels can be fabricated using CNC milling, laser ablation, conventional milling machine, CNC machining, embossing technique, powder compaction, microfabrication techniques such as DRIE, laser ablation, chemical etching, sintering, electroplating, and the like.

The width of the NR channel can be between about 5 μm to about 4 mm. Moreover, it is, determined through experiments with water that a width of 500 μm can be selected. The width selection depends on the considerations such as: (i) the generation of adequate number of bubbles to induce the liquid motion through the feeder channels, (b) avoiding using much larger widths that would reduce the heat transfer coefficient over longer developing region flow lengths under the current mechanism of separate liquid and vapor pathways, and (c) reduction in the area fraction available in the FC region since this region in general provides a more efficient heat transfer mechanism as compared to that in the NR regions.

Microstructures are arranged such that there is spacing between the structures to permit convective liquid flow about the structures induced by bubble departure from the NRs. The channels with nucleating regions, referred to as NR channels, provide the same function as nucleating regions. This spacing between multiple NR channels can be estimated using available departure bubble diameter equations or by experimentally measuring the departure diameter.

The width of the FC channel can be between about 5 μm to about 4 mm. The length of the FC can be from about 1 mm to about 10 mm. The width of the microchannel wall can be from about 100 μm to about 2 mm. The length of the FC channels can be smaller or larger for different fluids, such as refrigerants or any other boiling liquids, depending on their respective departure bubble diameters. These diameters can depend on the specific geometry of the heating surface with microstructures and also the heat flux levels. The bubble departure diameter for a particular geometry and fluid combination may be obtained from the experimental or theoretical considerations. An optimum spacing is determined from the heat transfer in the developing region of the feeder channels along its length. As an example, it is estimated to be about 50 percent to 200 percent of the theoretically estimated departure diameter. In many cases, experimental determination may be utilized to identify the optimized spacing that will yield the best performance.

The heat transfer mechanism in the FC is enhanced by the entrance region effect. Similar effect is seen when the liquid jet impinges on the heated surface in the FC region. When the liquid enters the open channels the liquid front is assumed to have uniform velocity. As it advances in the FCs, the liquid contacting the walls comes to a complete stop which induces high shear stress. This layer further causes the adjacent layers in the liquid to slow down as a result of friction between the layers. To maintain a constant mass flow rate inside the channel the velocity reduction at the walls is compensated by the liquid speed up in the center of the channel. These two effects induce a velocity gradient from zero velocity at the wall which gradually develops to the center of the channel as the liquid advances. The region of the channel from entry of the liquid to the development of the velocity profile towards the center is called the hydrodynamic entrance (developing) region which dictates the liquid flow in the FCs of the NRFC heat exchangers. Similar effect is observed for the temperature profile, with a very high heat transfer coefficient in this region, which decreases as the flow length increases. The liquid transport in the feeder channels may be assisted by the capillary flow when the channel dimensions are small enough to provide a capillary effect. The liquid flowing toward the heater surface may travel laterally over the feeder channels before entering these channels and flowing towards the NR channels. Another mechanism for bubble motion emerging from the NR is present when the bubble tuition is dictated by the evaporation momentum force. The bubble ebullition cycle is governed by evaporation momentum force (EMF). The asymmetric temperature conditions in the region containing the enhancement structure influences the bubble trajectory in such a way that the bubble moves towards the NR. This sets up the convective flow such that the vapor generated on the heat exchange region is removed through the NR channels with subsequent liquid addition to the NR through the FC.

The current disclosure deals with boiling liquid contacting the heat exchange region and turning into vapor. A nucleation site is defined as the location of bubble origination. In one of the embodiments of the NRFC configurations, the intersection of the FCs and NRs serve as preferential nucleation sites. In another embodiment, porous structures are incorporated, to promote nucleation in the NR.

The FCs can be coated with any structure that promotes heat transfer and liquid transport. Hydrophilic coatings will further enhance liquid wetting and delay CHF. When nanowires are coated it is advised that their heights remain small such that they promote liquid transport only and not serve as nucleation sites.

This disclosure deals with boiling of liquids wherein bubble nucleation occurs and is accompanied with transfer of heat from a surface to the boiling liquid.

A microstructure is defined as a structure generally from about 1 micrometer to about 4 millimeters in one of its dimensions on the heat transfer surface. It also forms pan of the heat transfer surface. It includes, but is not limited to microchannels, pin fins, and elevated or depressed regions. The FC can be flush with the heat transfer surface, or it may be elevated or depressed from the heat transfer surface.

Wall superheat is defined as the difference between the substrate surface temperature and the saturation temperature of the liquid. Heat transfer coefficient is defined as the ratio of heat flux dissipated by the substrate to the wall superheat. The CHF condition is initiated by a blanket of vapor over the heater surface preventing the liquid from coming in contact with the heater surface. Under constant heat flux heating condition, reaching CHF leads to a rapid increase in heater surface temperature and may cause thermal damage to the surface (also known as burnout). In a boiling curve, the wall superheat is plotted on the x-axis against the heat flux on the y-axis. CHF represents the highest heat flux beyond which an increase in heat flux is accompanied with a significant rise in wall temperature and a dramatic reduction in heat transfer coefficient as compared to the boiling prior to reaching the CHF condition. Vapor blankets the heater surface at and beyond CHF condition.

The channel dimensions of both the NR channels and FCs have an important role to play in determining the pool boiling performance. The channel dimensions affect the liquid and vapor transport in fundamentally different ways. Nucleation region includes the areas near corners between the NR and adjacent FC regions. Liquid flow paths along the heat exchange regions occur through the FCs. Having a very wide FC reduces the available nucleation sites due to the reduced areas of the corners between the NR and FC regions, and also reduces the heat transfer coefficient and available surface area from the walls or fins forming the channels, whereas reducing the channel width increases nucleation sites but may affect the liquid transport to the nucleation sites. The NR channels are bound by FCs which influences the liquid from the bulk to enter the FCs and feed to the nucleation sites. Liquid is supplied to the nucleation sites through the FCs and also due to the counter flow influenced by the chaotic liquid vapor disturbance. In other embodiments, nucleating may occur over the entire NR and liquid flow toward the nucleating cavities in the NR region is affected by the width of the NR channels.

The spacing between two adjacent NR channels also plays an important role in enhancing the performance. Making the spacing too small or too wide in comparison to the departure bubble diameter will deteriorate the performance. Small spacing might disrupt the convective flow as the chaotic nature of boiling at high heat fluxes causes the vapor to be removed in different pathways than desired. A wide spacing may not set up the desired liquid-vapor pathways and sometimes may result in undesired nucleation in the FC.

In another embodiment, the bubble escape pathway is in the vertically upward direction from the NR from a horizontal heat exchange surface in a gravity driven system. However, the bubbles may be removed under the influence of any other force away from the nucleation sites in this or other orientations such that they do not interfere with the convective liquid flow pathways in the FC.

In another embodiment, the bubble motion is influenced by the evaporation momentum force. This force arising due to specific microstructure geometry or due to asymmetric temperature conditions on the heat exchange region of the microstructures causes the bubble to move towards the NR regions. At higher heat fluxes this force dominates the mechanisms such that both the CHF and HTC at CHF is enhanced by about 50% or more when compared to a heat exchange region without any microstructures, coating or any structure that improves the pool boiling performance.

In another embodiment, the CHF is enhanced at least by 100 percent and the HTC at 80% of the CHF is enhanced by at least 100 percent.

In another embodiment, the CHF is enhanced at least by 100 percent and the HTC at 80% of the CHF is enhanced by at least 150 percent.

In another embodiment, the CHF is enhanced at least by 200 percent and the HTC at 80% of the CHF is enhanced by at least 50 percent.

In another embodiment, the CHF is enhanced at least by 200 percent and the HTC at 80% of the CHF is enhanced by at least 100 percent.

In another embodiment, the CHF is enhanced at least by 200 percent and the HTC at 80% of the CHF is enhanced by at least 150 percent.

In another embodiment, the CHF is enhanced at least by 100 percent and the HTC at 80% of the CHF is enhanced by at least 100 percent.

In another embodiment, the CHF is enhanced at least by 100 percent and the HTC at 80% of the CHF is enhanced by at least 150 percent.

In another embodiment, the CHF is enhanced at least by 200 percent and the HTC at 80% of the CHF is enhanced by at least 50 percent.

In another embodiment, the CHF is enhanced at least by 200 percent and the HTC at 80% of the CHF is enhanced by at least 100 percent.

In another embodiment, the CHF is enhanced at least by 200 percent and the HTC at 80% of the CHF is enhanced by at least 150 percent.

In another embodiment, the CHF is enhanced at least by 100 percent and the HTC at 80% of the CHF is enhanced by at least 50 percent.

In another embodiment, the CHF is enhanced at least by 100 percent and the HTC at 80% of the CHF is enhanced by at least 100 percent.

In another embodiment, the CHF is enhanced at least by 100 percent and the HTC at 80% of the CHF is enhanced by at least 150 percent.

In another embodiment, the CHF is enhanced at least by 200 percent and the HTC at 80% of the CHF is enhanced by at least 50 percent.

In another embodiment, the CHF is enhanced at least by 200 percent and the HTC at 80% of the CHF is enhanced by at least 100 percent.

In another embodiment, the CHF is enhanced at least by 200 percent and the HTC at 80% of the CHF is enhanced by at least 150 percent.

In another embodiment, the CHF is enhanced at least by 100 percent and the HTC at 60% of the CHF is enhanced by at least 50 percent.

In another embodiment, the CHF is enhanced at least by 100 percent and the HTC at 60% of the CHF is enhanced by at least 100 percent.

In another embodiment, the CHF is enhanced at least by 100 percent and the HTC at 60% of the CHF is enhanced by at least 150 percent.

In another embodiment, the CHF is enhanced at least by 200 percent and the HTC at 60% of the CHF is enhanced by at least 50 percent.

In another embodiment, the CHF is enhanced at least by 200 percent and the HTC at 60% of the CHF is enhanced by at least 100 percent.

In another embodiment, the CHF is enhanced at least by 200 percent and the HTC at 60% of the CHF is enhanced by at least 150 percent.

The desired spacing between adjacent nucleating regions separated by feeder channels is approximately equal to the departure bubble diameter. In one embodiment, due to other effects such as local fluid flow fields around growing bubbles, the desired spacing between adjacent nucleating regions separated by feeder channels may be between 50 percent smaller to 200 percent larger than the departure bubble diameter. As the feeder channel length increases, the heat transfer rate in the feeder channels decreases due to the increasing lengths of the developing region in the FCs. This may also be used in deciding the appropriate spacing between the NR channels. The desired spacing between the NR channels will depend on the liquid properties and the bubble nucleation characteristics. The nucleation characteristics will also depend on the fabrication method employed. In an embodiment, it is demonstrated that for water at atmospheric pressure the Fritz equation can be employed to determine the desired spacing between the NR channels. For other liquids, the departure bubble diameters can be found from experiments and applied to calculate the desirable spacing between the NR channels on the heat exchange region. These equations provide guidance for determining the desired spacing. At higher heat fluxes, including near CHF conditions, the bubble departure diameters are different due to rapid growth and departure. This value may be different from the theoretical estimation of the departure diameter. In an embodiment a spacing range from 50 percent to 200 percent of the estimated departure bubble diameters can be used. The spacing may be smaller if the bubbles leave rapidly, or may be larger due to bubble coalescence.

In another embodiment the enhancement structure can include a plurality of NR channels separated by the bubble departure diameter. The separation is incorporated with liquid feeder channels that enhance the heat transfer performance. The number of NR channels is determined by the length and width span of the heat exchange region. It is preferred that the NR channels be bounded by the FCs to permit continuous self-sustained convective flow of liquid and vapor in separate pathways. The NR in another embodiment may be formed as isolated regions from other NR separated by adjacent FCs.

FIG. 1 illustrates an example of various embodiments of NRFC configurations placed on a heat exchange region. FIG. 1(*a*) Shows a microstructure with the NR placed horizontally and the FCs placed perpendicular to the NR channels. FIG. 1(*b*) shows the FCs placed horizontally and the NR perpendicular to the FCs. FIG. 1(*c*) shows the NRFC placed on the outside surface of a tubular structure. FIG. 1(*f*) shows a radial arrangement of the NRFC configuration. FIGS. 1(*d*) and (*e*) shows the NR channels as a rectangular and triangular groove with FCs running between them.

A heat exchange system including microchannels as feeder channels presents unique opportunities to enhance the performance. In accordance with the present disclosure, when bubbles are formed at the intersection of NR channels and FC they influence the liquid transport through the feeder channels which sets up the convective flow in that fashion permitting self-sustained separate liquid and vapor flow fields over the enhanced geometry.

In another embodiment, the substrate can be the outside surface of a tube subjected to liquid boiling over it. The outside tube surface is covered with microstructures composed of NR and FC such that the NR channels are separated by the bubble departure diameter and are bounded by the feeder channels.

Figure 2:
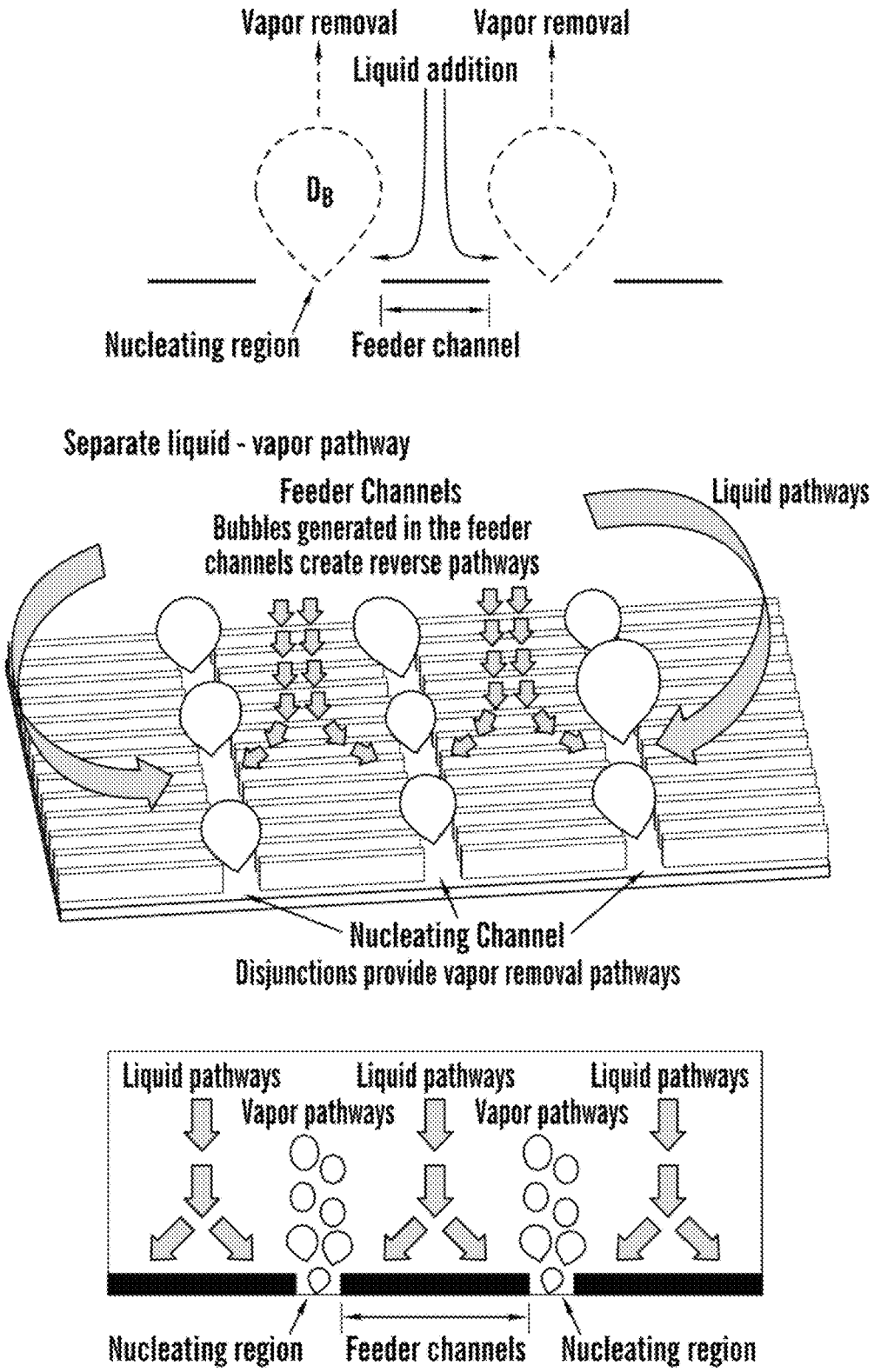
FIG. 2 is a series of drawings representing mechanisms showing separate liquid and vapor pathways in accordance with heat exchanger configuration embodiments.

FIG. 2 shows an embodiment of a mechanism to enhance performance by providing separate liquid and vapor pathways, (a) Schematic view, and (b) 3-D view. FIG. 2 illustrates an embodiment with the schematic representation of the mechanism prevalent in the NRFC configuration. The FCs and NR channels are fabricated on smooth surfaces such that bubbles are removed through the NR channels as a result of evaporation momentum force while liquid supply occurs through the FCs. Evaporation momentum force appears on a liquid-vapor interface as liquid evaporates into vapor which moves away from the interface at high velocity. The spacing between the NR channels is approximately equal to bubble departure diameter, which may be determined through equations known to those skilled in the art or can also be obtained experimentally. The FIG. 2 identifies the bubble removal pathways through the NR channels with liquid supply in both the vertical and lateral directions through the FCs.

In one of the embodiments, an NRFC configuration is developed on a copper heat exchange region. The NR channels and FCs are manufactured using CNC milling process. The feeder channels can be considered as open microchannels that influence liquid flow through capillary motion towards the preferred nucleation sites located at the intersection of NR channels and FCs.

The heat exchange region is composed of NR channels and FCs. The NR channels and FC can be on the same plane on the heat exchange region or the can be elevated or depressed with respect to each other. The preferred depth of the FC and NR channels is estimated to be in the range of about 0 to about 10 mm. In another embodiment, the preferred depth is from about 1 μm to about 10 μm. For example, the NR Channel can have a depth of 8 mm while the FC can be 6 mm deep or the NR channel can be 6 mm deep while the FC can be 8 mm deep. These configurations are acceptable as long as the arrangement permits self-sustained convective flow of liquid through the FCs and bubble departure through the NR channels.

Figure 3A:
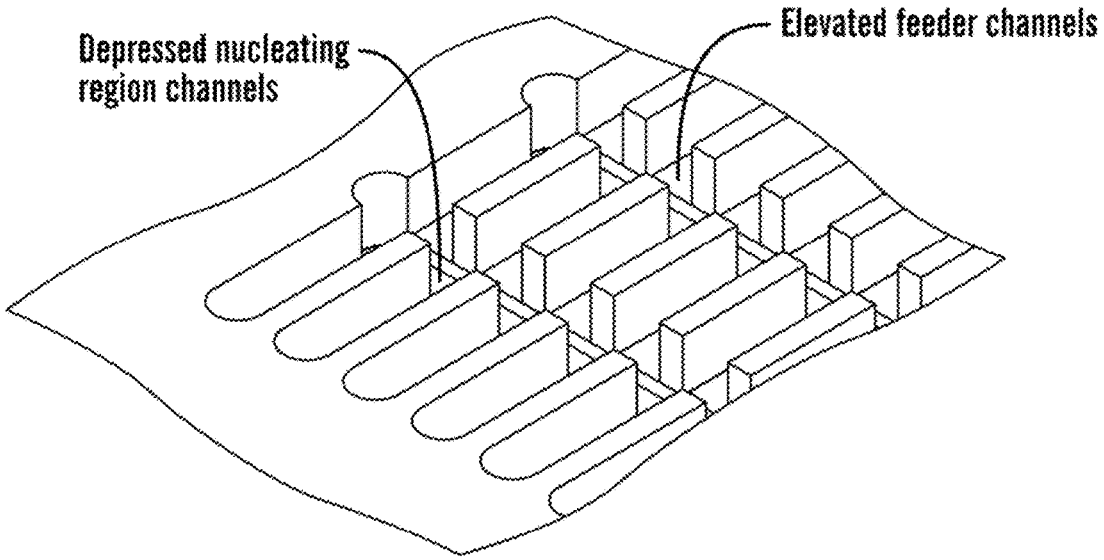
FIG. 3 is a series of 3-D drawings of the NRFC heat exchanger with varies height configurations of NRs and FCs.
Figure 3B:
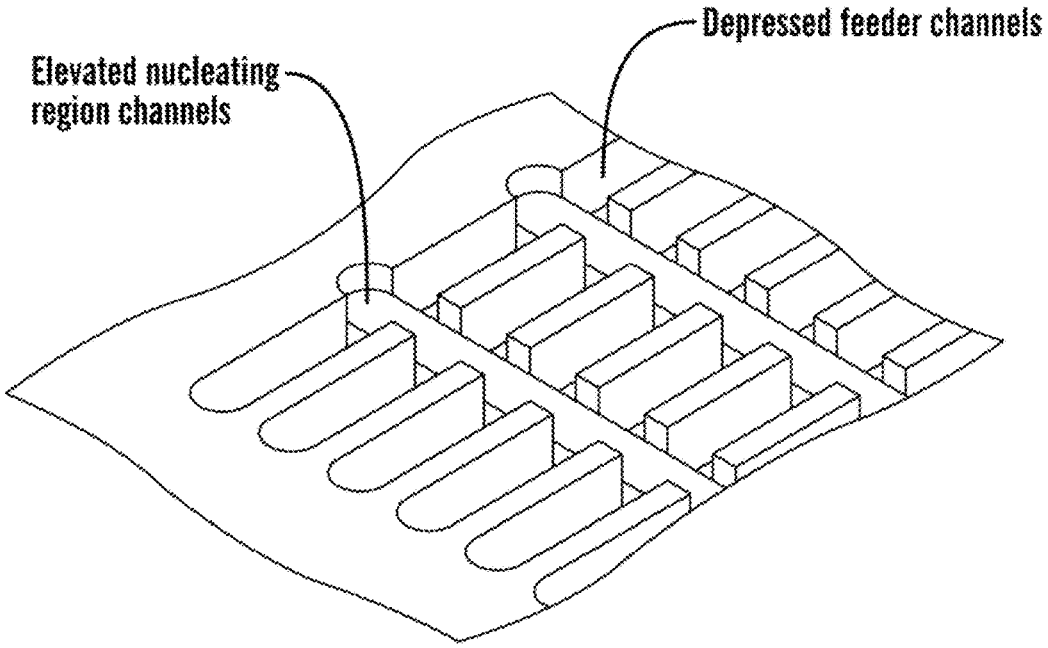
Figure 3C:
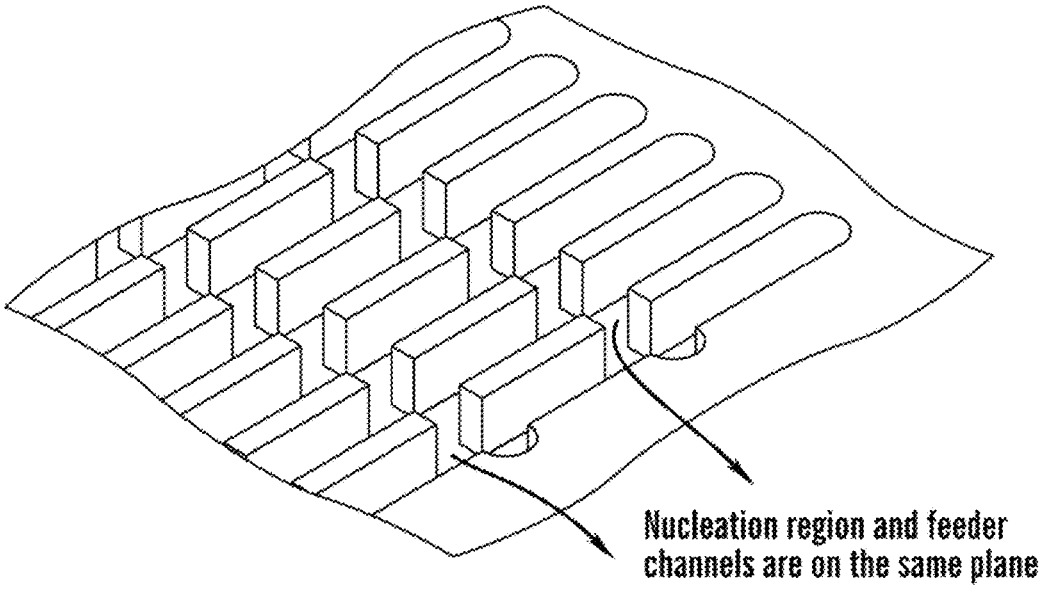

FIG. 3 Shows various depth configurations of NRFC heat exchangers. FIG. 3 illustrates the possible variations of the depth of NR channels and FCs such the preferred vapor removal pathway occurs through the NR channel and liquid addition through the FC. The possibilities are illustrated with respect to the bottom plane of the NR and FC channels. FIG. 3(*a*) shows the NR channels depressed relative to the feeder channels. FIG. 3(*b*) shows the FC channels depressed with respect to the NR channels. FIG. 3(*c*) shows the NR channels and FC in the same plane with respect to each other.

The preferred width of the FC and NR is estimated to be in the range of about 5 μm to about 4 mm.

The preferred spacing between two FCs, i.e., wall width, can be in the range of about 100 μm to about 2 mm.

Liquid re-circulation in microchannels is an important factor to enhance performance and delay CHF. In order to delay CHF and facilitate continuous liquid supply, disjunctions in the fins are proposed to serve as vapor removal pathways as shown in FIG. 2.

Furthermore, the bubble departure diameter is an important parameter in enhancing the performance which facilitates separate liquid-vapor flow fields. The bubble mergence in the lateral and vertical direction at higher heat fluxes can be identified as the chief contributing factor for the vapor blanket to appear on the heater surface. It is postulated that for water boiling on a copper heater surface at atmospheric conditions the feeder channel bank width on the heat exchange surface should approximately be equal to the departure bubble diameter. The Fritz equation, relates the contact angle and surface tension forces to the bubble departure diameter as, $$d_{oF} = 0.0208\beta\left[\frac{\sigma}{g(\rho_L - \rho_G)}\right]^{1/2} \quad (1)$$

where, β is the receding contact angle, σ is the surface tension force, g is the gravitational force and $\rho_L$ and $\rho_G$ are the liquid and vapor densities respectively. The departure bubble diameter ($d_{oF}$) is calculated using eq. (1) and is equal to 2.213 mm for β=42.5°, σ=58.91×10$^{-3}$ N/m for water at 100° C. The theory provided by Fritz is generally seen to be valid but there are deviations observed in experimental data.

A heat transfer surface made of nucleating regions on a heated substrate, subjected to pool boiling of a liquid over it, and liquid feed regions on the heated surface directing liquid toward the nucleating region is investigated for pool boiling enhancement. Nucleating region includes channels incorporating nucleation cavities, either artificial or naturally occurring from a manufacturing process, and liquid feed region includes feeder microchannels in one of its embodiment. The spacing between the nucleating regions is a factor that is important in the boiling performance. In one of its embodiments, when the spacing between adjacent nucleating regions is in the vicinity of the bubble departure diameter, either estimated using a theoretical equation or measured from experiments, it provides a higher degree of boiling performance enhancement. This spacing avoids vapor flow from being blocked by opposing liquid flow and leads to a high critical heat fluxes. The liquid is fed to the nucleating regions through the feeder channels. This results in separate liquid pathways toward and vapor pathways away from the nucleating regions. The boiling process being chaotic, other liquid vapor pathways, such as liquid flowing along the heater surface within the nucleating region, or liquid flowing directly from the bulk into the nucleating channels in some areas is also present to a varying degree. Similarly, some degree of nucleation may also be present in areas other than the nucleating regions, including the feeder regions. However, overall effect is to enhance the critical heat flux through the boiling process based on the main mechanism of separate liquid-vapor pathways provided by incorporating the above structure. The heat transfer coefficient is also improved over a plain surface due to this enhancement mechanism.

Liquid rewetting on a heated surface is a factor in delaying critical heat flux (CHF) for enhancing pool boiling performance. Pool enhancement is achieved by providing improved liquid supply pathways to nucleation sites. Heat transfer surfaces composed of Nucleating Regions with Feeder Channels (NRFC) was experimentally investigated with distilled water at atmospheric pressure. The bubble departure diameter is used as guidance in designing the spacing; between the nucleating channels on a copper chip. A CHF of 394 W/cm$^2$ at a wall superheat of 5.5° C. with a heat transfer coefficient (HTC) of 713 kW/m$^{2\circ}$ C. was obtained with a feeder bank width of 2.125 mm and a nucleating channel width of 0.5 mm. High speed images suggested that separate liquid and vapor pathways were the driving mechanism. Such arrangements of NR and FCs in multiple networks can lead to CHF enhancement between 50-250% and a simultaneous heat transfer coefficient enhancement between 50-1000%.

Self-sustained separate liquid-vapor pathways are identified as enhanced mechanisms which can be viewed in high speed images of boiling indicating vapor leaving the surface from the NRs and the liquid from the hulk approaching the surface toward the NRs through the FCs in separate pathways.

The disclosure will be further illustrated with reference to the following specific examples. It is understood that these examples are given by way of illustration and are not meant to limit the disclosure or the claims to follow.

Example 1

In an embodiment of the enhancement structure, NRs and adjacent FCs are fabricated to facilitate separate liquid and vapor pathways, as shown in FIG. 2. Disjunctions on an open microchannel surface with feeder channel bank width equal to the departure bubble diameter is proposed as a means to enhance performance by minimizing bubble coalescence in the lateral direction. These disjunctions added to an open microchannel can be considered as Nucleating Regions with Feeder Channels (NRFC). The nucleating channels will serve as preferential vapor removal pathway with liquid addition through the microchannels.

Figure 4:
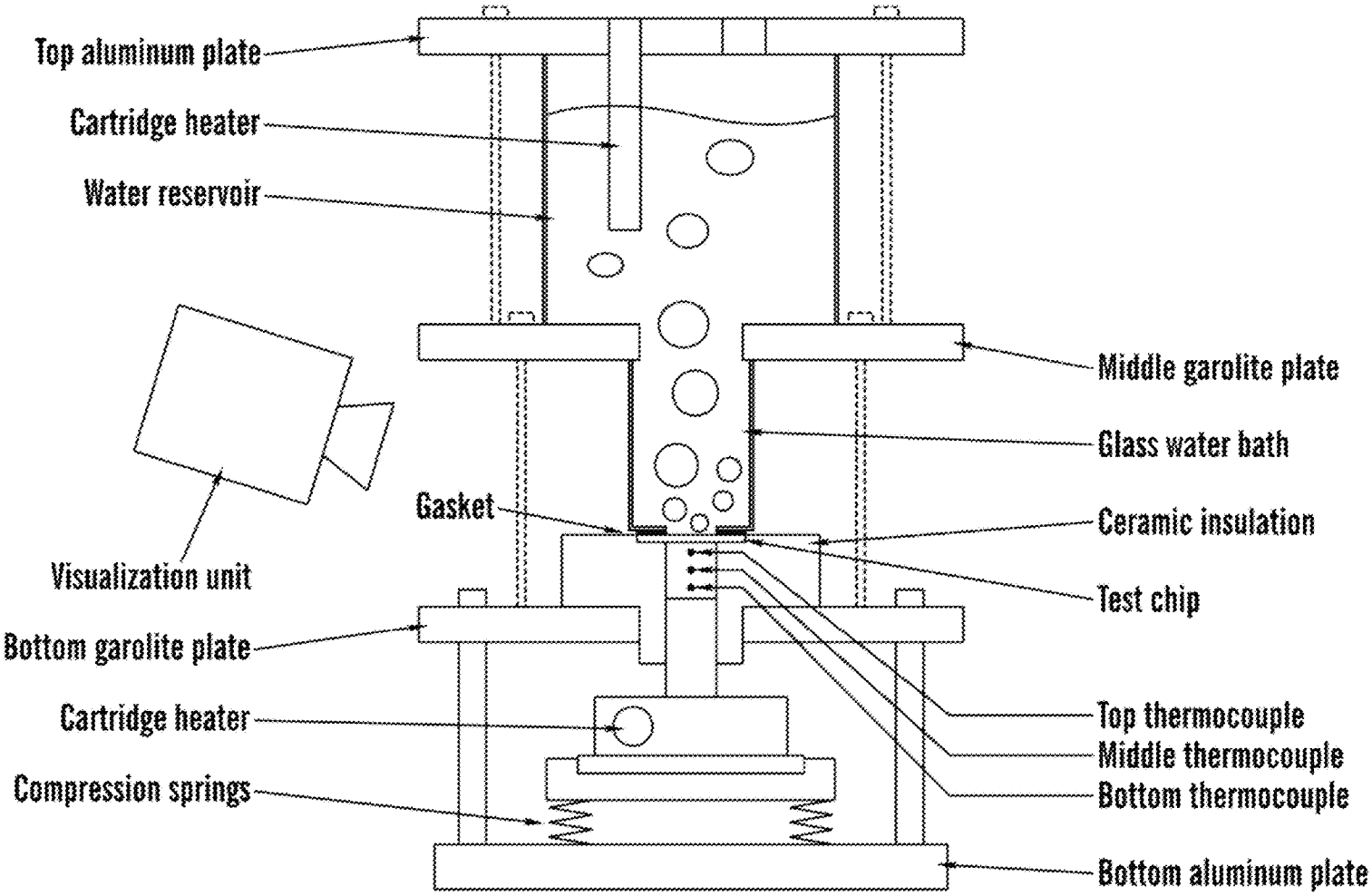
FIG. 4 is a drawing of a pool boiling; experimental setup for water.

FIG. 4 shows the schematic of the pool boiling test setup for water. The bottom garolite plate is composed of a ceramic chip holder to hold the heater surface over which a quartz glass water bath measuring 14 mm×14 mm×38 mm is assembled by means of 4 stainless steel socket head cap screws. A glass water bath is used chiefly to aid visualization and is sealed to the ceramic chip holder by means of a rubber gasket which covers the area outside the boiling surface. A reservoir water bath is mounted between the middle garolite plate and top aluminum plate. The water reservoir is sealed with rubber gaskets on either side to ensure against leakage at all times. The top aluminum plate is provided with two circular openings for the saturation thermocouple probe and a 60-VDC, 200 W auxiliary cartridge heater to maintain water in the reservoir at saturation by boiling continuously.

The bottom section of the setup consists of a 120-VDC, 4×200 W capacity cartridge heater inserted into a copper heater block similar to Kalani and Kandlikar. The copper block is composed of a truncated portion measuring 10 mm×10 mm×40 mm that fits into the groove on the bottom side of the ceramic chip holder. This ensured that 10 mm×10 mm surface of the heater is in contact with the test chip which also has a base section measuring 10 mm×10 mm which facilitated ID conduction from the heater to the test chip. A Grapfoil® paper attached to the heater surface ensured good contact between the test chip and the heater block. Additionally, the copper block is housed on a ceramic sleeve to minimize heat losses. Four compression springs supported the bottom aluminum plate that provided the required degree of movement to establish contact between the test chip and the heater and to accommodate for any expansion during the testing. A shaft pin (⅜" diameter) connected the middle garolite plate, bottom garolite plate and the work desk which ensured stability of the setup.

A National instruments eDaq-9172 data acquisition system with NI-9213 temperature module was used to record the temperature. A LabVIEWVR virtual instrument displayed and calculated the surface temperature and heat flux.

Figure 6:
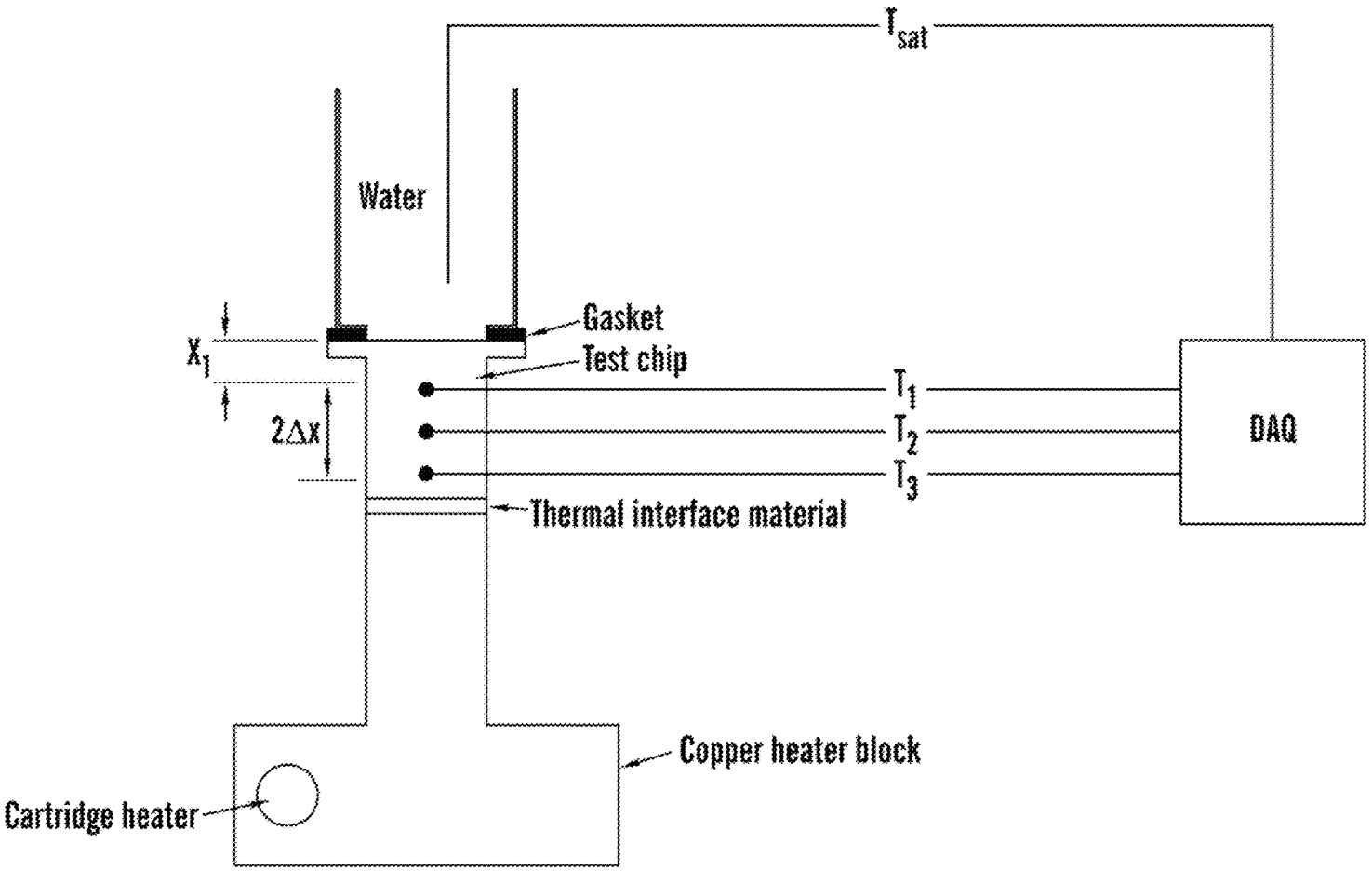
FIG. 6 is a drawing of a schematic of a heater section.

The test section used in this study was a 17 mm×17 mm×9 mm as shown in FIG. 6. The heater side consisted of a 10 mm×10 mm×9 mm protrusion with three 0.56 mm holes drilled 3 mm apart to accommodate the thermocouples. The effect of contact resistance in the heat flux calculation is eliminated by holes drilled in the test chip. Three K-type thermocouples are inserted into these holes to read the temperature at different locations on the chip.

Figure 5:
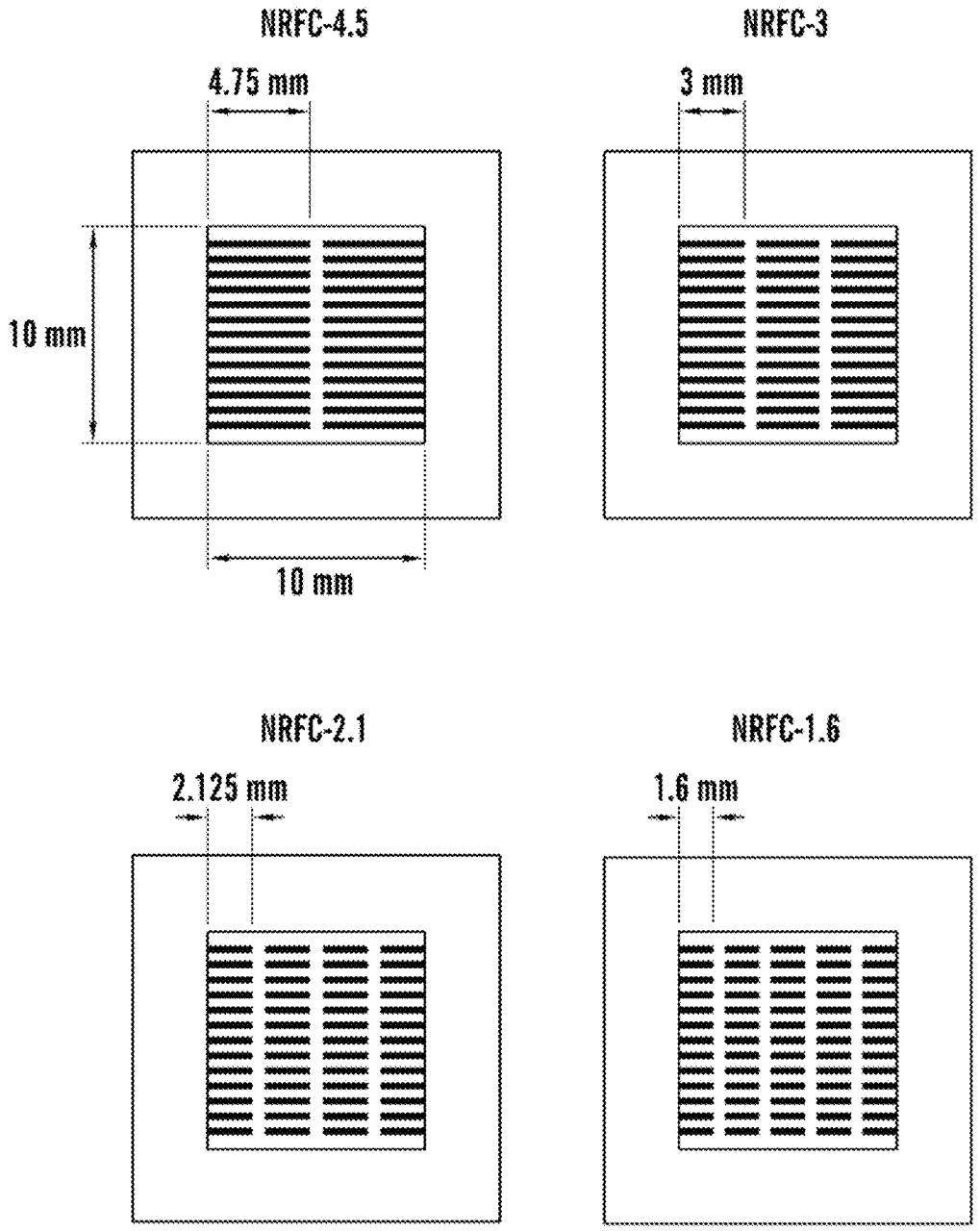
FIG. 5 is a drawing of various test chips with the NRFC configuration with feeder spacing.

The location of the channels (channel width=500 μm) are as shown in FIG. 5. On the 10 mm×10 mm boiling surface, spacing of 4.75 mm, 3 mm, 2.125 mm and 1.6 mm are machined such that the NR channels (channel width 500 μm) are hounded by FCs, NRFC-2.1 is expected to have the highest performance in the test surfaces investigated here as it is in close correspondence to the bubble departure theory discussed previously. This departure diameter was estimated by using Fritz equation (Eqn. 1). NRFC-4.5, 3 and 1.6 contribute in identifying a trend in the performance providing further insights into the self-sustained separate liquid-vapor pathway mechanisms.

FIG. 5 represents various test chips with NRFC configurations. FIG. 5 shows an assembly of the heater section. The heat flux to the test section was calculated using 1D conduction equation $$q'' = -k_{Cu}\frac{dT}{dx} \tag{2}$$

where, the temperature gradient dT/dx was calculated using the three point backward Taylor's series approximation $$\frac{dT}{dx} = \frac{3T_1 - 4T_2 + T_3}{2\Delta x} \tag{3}$$

where, $T_1$, $T_2$, $T_3$ are the temperatures corresponding to the top, middle and bottom of the test chip under study.

The boiling surface temperature was obtained by using eq. (2) and is given by, $$T_{wall} = T_1 - q''\left(\frac{x_1}{k_{Cu}}\right) \tag{4}$$

where, $T_{wall}$ is the boiling surface temperature and $x_1$ is the distance between the boiling surface and, thermocouple $T_3$ which is equal to 1.5 mm.

FIG. 6 shows a schematic of the heater section. In this study, a heat exchange surface with nucleating regions and feeder channels is tested for its pool boiling performance. This configuration has not been investigated in pool boiling with water and FC-87 as the working liquid. The NRs and FCs were fabricated using CNC machining on the central 10 mm×10 mm area of the boiling surface of the chip. Table 1 shows the microchannel dimensions used in the study after measuring under a confocal laser scanning microscope. The pool boiling performance was obtained to study the effect of feeder spacing, nucleating channel width and feeder channel width.

Bias and precision errors are the two main errors that arise during an experimentation process. Errors from calibration and sensitivity are the main source of bias and precision errors respectively.

The general expression for the bias and precision errors are, $$U_y = \sqrt{B_y^2 + P_y^2} \tag{4}$$

where, $U_y$ is the uncertainty or error, $B_y$ is the bias error and $P_y$ is the precision error.

Individually, each error that propagated due to measurement in temperature (both heater and surface temperature) and also distance between thermocouple spacing are calculated using the equation below, $$U_p = \sqrt{\sum_{i=1}^{n}\left(\frac{\partial p}{\partial a} * u_{ai}\right)^2} \tag{5}$$

where $U_p$ is the uncertainty in the parameter p, and $u_{\alpha i}$ is the uncertainty of measured parameter $\alpha_i$. The uncertainty in the heat flux can thus be expressed by the following equation.

$$\frac{U_{q''}}{q''} = \sqrt{\left[\left(\frac{U_k}{k}\right)^2 + \left(\frac{3U_{T_1} * k_{Cu}}{\Delta x * q''}\right)^2 + \left(\frac{4U_{T_2} * k_{Cu}}{\Delta x * q''}\right)^2 + \left(\frac{U_{T_3} * k_{Cu}}{\Delta x * q''}\right)^2 + \left(\frac{U_{\Delta x}}{\Delta x}\right)^2\right]} \tag{6}$$

Figure 7:
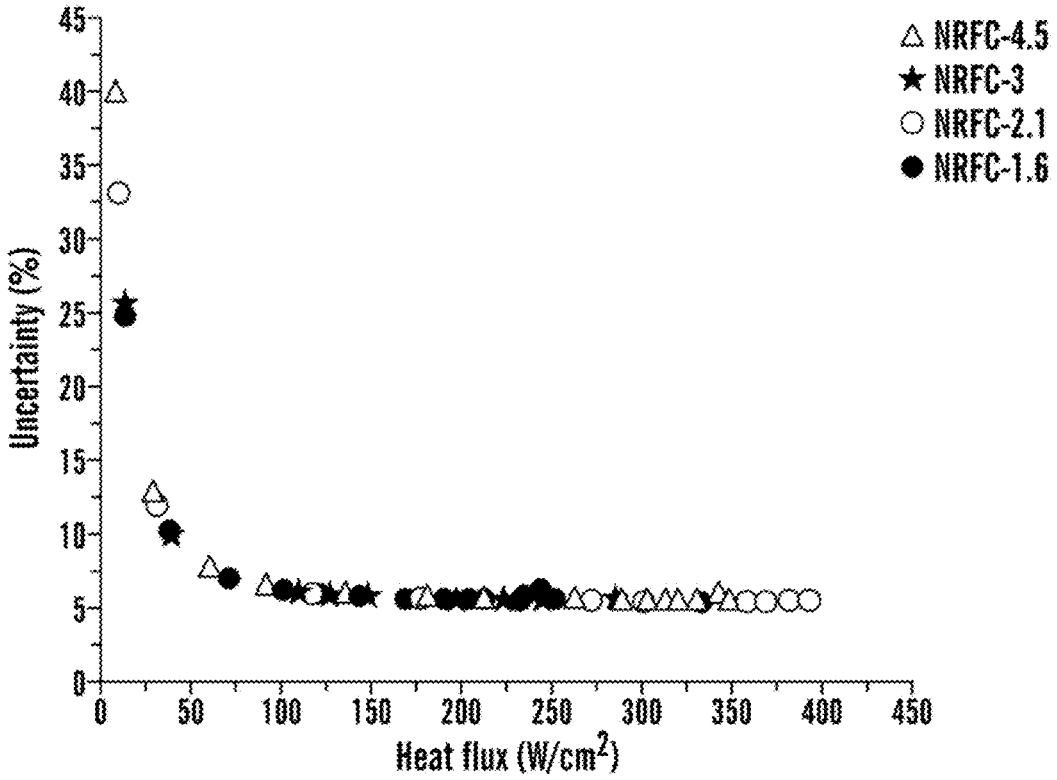
FIG. 7 is a graph of the variation in uncertainty with heat flux for NRFC test surfaces.

FIG. 7 shows the variation of heat flux with uncertainty. A maximum uncertainty of 40% is observed at a low heat flux but this value plateaus to less than 5% at higher heat fluxes which is the main region of interest in this study.

Figure 8:
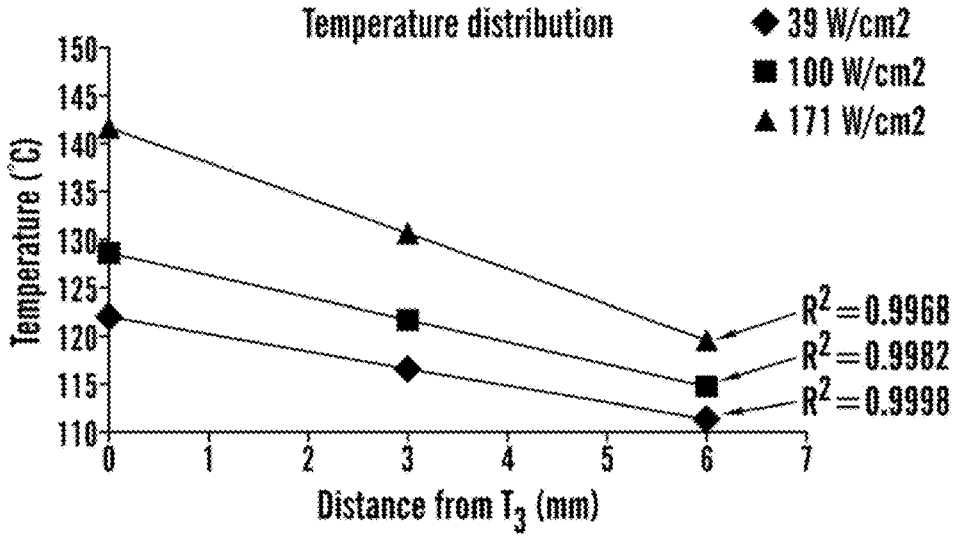
FIG. 8 is a graph of the temperature distribution at different heat fluxes.

FIG. 8 shows the variation of temperature along the length of the thermocouples. Based on Fouriers's law of conduction, the temperature profile across the test section is expected to be linear. The temperature distribution plot for 39 W/cm2, 100 W/cm2 and 171 W/cm2 showed linear progression with R squared value close to 1 which ensured minimal heat loss during the experimental process.

FIG. 8 illustrates temperature distribution at different heat flux value. The entire test setup was assembled and distilled water was filled in both the water bath and reservoir and visually inspected for leakage. The auxiliary heater and the cartridge heater were powered by two independent power supplies. The power was increased in periodic intervals once the working liquid (distilled water) attained saturation temperature. Data was recorded at each interval when the thermocouple fluctuation was not greater than ±0.1% for duration of approximately 10 min.

Pool boiling experiments were conducted with distilled water at atmospheric pressure for the test matrix shown in Table 1. To serve as a baseline for enhancement comparisons distilled water was boiled over a plain surface. This chip reached a CHF of 128 W/cm$^2$ at a wall superheat of 20° C. Three sets of tests are conducted on the enhanced surfaces to study the (i) effect of feeder channel spacing (or feeder bank widths) (ii) effect of nucleating region channel width, and (iii) effect of feeder channel widths.

TABLE 1

Nucleating channels microchannel dimension

| Chip | FC channel width (μm) | FC fin width (μm) | NR channel width (μm) | NR channel depth (μm) |
|---|---|---|---|---|
| NRFC-4.5 | 493 | 203 | 489 | 421 |
| NRFC-3 | 513 | 189 | 494 | 383 |
| NRFC-2.12 | 497 | 191 | 493 | 403 |
| NRFC-1.6 | 510 | 206 | 520 | 396 |

The results are presented in terms of a pool boiling curve which depicted the heat flux dissipated at a certain wall superheat. The heat flux is computed individually using both the projected area and normalized surface area of the test chips. The wall superheat is defined as the difference in temperature between the surface of the chip and saturation temperature of the fluid (distilled water). The surface temperature is calculated as the temperature at the fin tops of the configuration. The heat transfer performance curve which is a plot of heat transfer coefficient versus heat flux revealed the heat dissipating capability of the chip compared to a plain chip.

Figure 9:
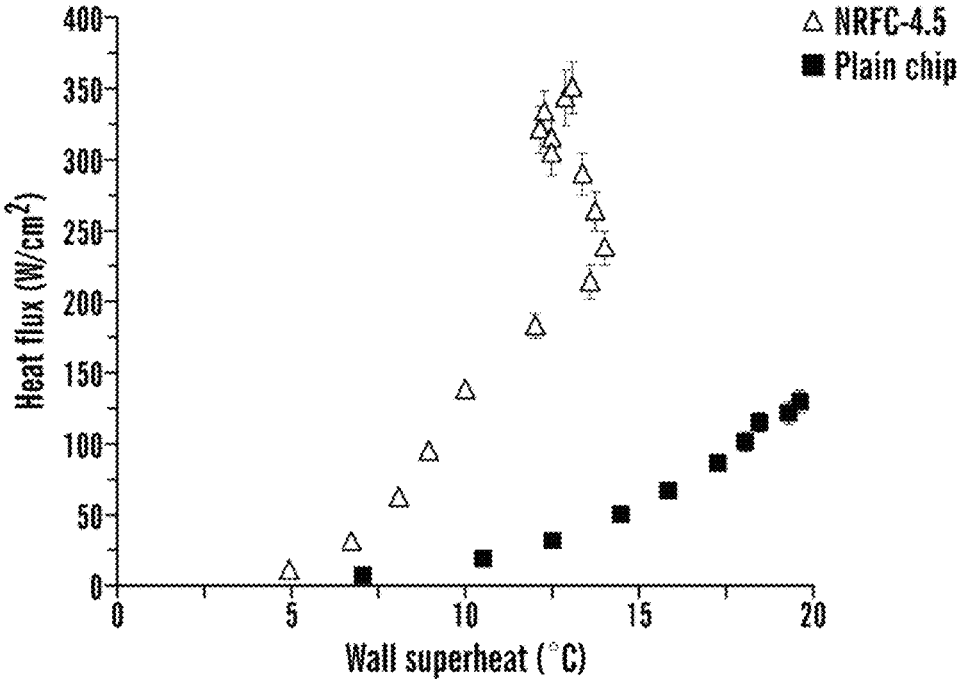
FIG. 9 is a graph showing the pool boiling comparison of NRFC-4.5 and NRFC-1.6.

The plain chip had a roughness of 1.2 μm which was measured using a confocal laser scanning microscopy. To draw a first-hand conclusion on the design of NRFC heat exchanger and to identify its boiling potential, NRFC-4.5 was boiled in distilled water to draw an estimate on the degree of enhancement and the boiling curves are shown in FIG. 9. The NRFC-4.5 chip showed significant enhancement with a CHF of 350 W/cm2 at a wall superheat of 13° C. as against a plain chip which, had a CHF of 128 W/cm2 at a wall superheat of 20° C. which corresponded to an enhancement of 182% in CHF. The results suggested that the design of the heat exchanger resulted in increased CHF with a simultaneous increase in HTC.

FIG. 9 shows a pool boiling comparison between NRFC-4.5 and plain chip.

Effect of Feeder Spacing

Figure 10:
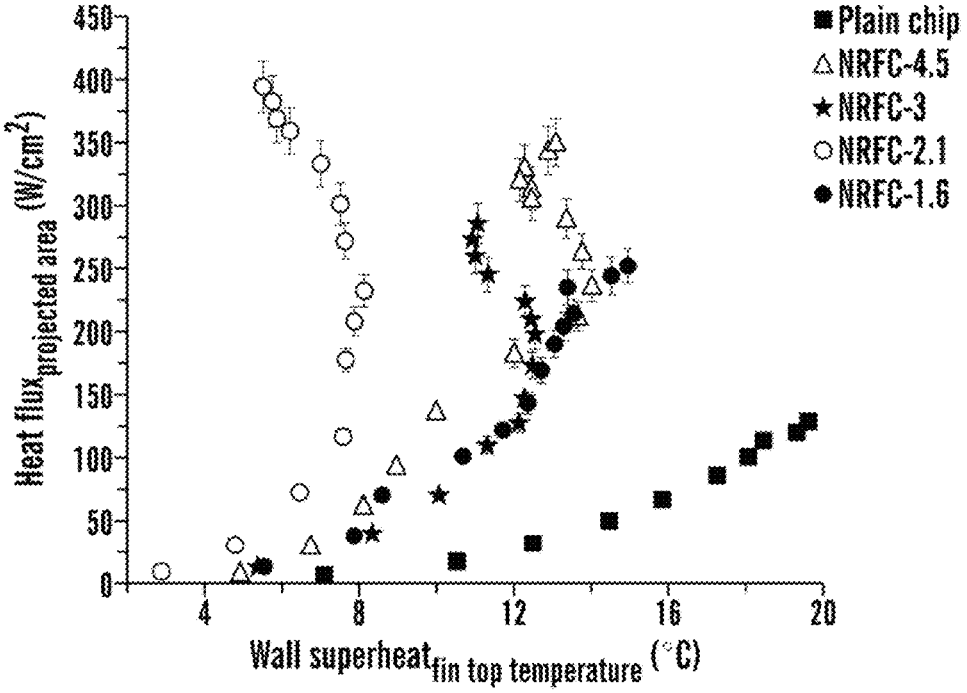
FIG. 10 is a graph showing the pool boiling curves for NRFC-45, NRFC-3, NRFC-2.1 and NRFC-1.6.

The objective of this section was to identify the effect of feeder spacing on the pool boiling performance. Four chips identified as NRFC-4.5, NRFC-3, NRFC-2.1, NRFC-1.6 were tested for their pool boiling performance as shown in FIG. 10. The nomenclature for naming the surfaces was such that the heat exchanger (NRFC) was followed by the feeder spacing distance in mm. The analysis is targeted at identifying the optimum spacing between feeder banks to enable separate liquid-vapor pathways. The test chips were pushed to CHF to determine the maximum performance of these surfaces from which the operating range of the heat exchanger can be established.

NRFC-2.1 dissipated 394 W/cm$^2$ at a wall superheat of 5.5° C. which translated to an enhancement of 217% in CHF compared to a plain surface. NRFC-4.5, 3 and 1.6 had CHFs of 349 W/cm$^2$, 285 W/cm$^2$ and 252 W/cm$^2$ at wall superheats of 13° C., 11° C. and 14.9° C., respectively. NRFC-1.6 with the lowest CHF of 255 W/cm$^2$ amongst the enhanced surfaces was comparable to the best performing chip reported by Cooke and Kandlikar with a CHF of 2.44 W/cm$^2$. From a simplistic approach, although the area enhancement was reduced compared to open microchannels, the performance was enhanced which suggested that self-sustained separate-liquid vapor pathway was the driving mechanism here. The results are supplemented with high speed images which reveal bubble dynamics in the enhanced configuration at low heat fluxes which is described in the discussion section.

FIG. 10 shows boiling curves for plain and nucleating channels microchannel surfaces with water at atmospheric pressure with fin top temperature.

Figure 11:
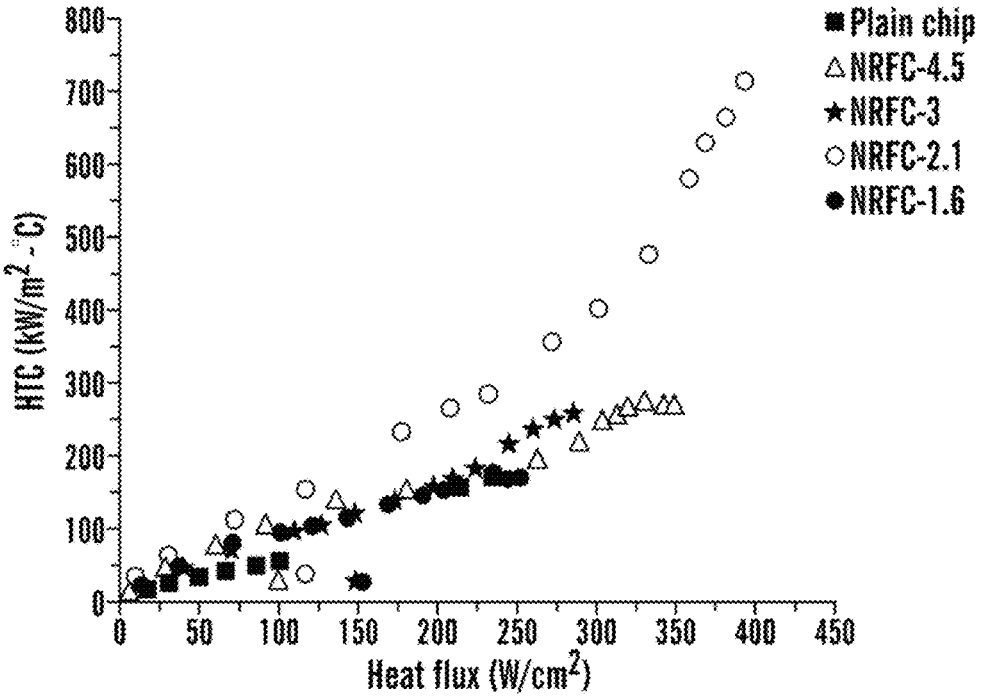
FIG. 11 is a graph showing the heat transfer performance obtained with NRFC-4.5, NRFC-3, NRFC-2.1 and NRFC-1.6.

FIG. 11 illustrates heat transfer coefficient comparison for plain and nucleating channels microchannel surfaces using fin top temperature. FIG. 11 shows the variation of HTC with heat flux. Similar trend to FIG. 9 is observed in HTC. At CHF, HTC of 267 kW/m2° C., 257 kW/m2° C. and 168 kW/m2° C. is observed with NRFC-4.5, 3 and 1.6, respectively. NRFC-2.1 had the best performance with a HTC of 713 kW/m$^{2}$° C. representing an enhancement of 996% in HTC at CHF over a plain chip.

TABLE 2

Test matrix and results

| Chip | CHF (W/cm$^2$) | Wall superheat (° C.) | Area enhancement factor |
|---|---|---|---|
| NRFC-4.5 | 349 | 13 | 2.04 |
| NRFC-3 | 285 | 11 | 2.01 |
| NRFC-2.12 | 394 | 5.5 | 1.97 |
| NRFC-1.6 | 252 | 14.9 | 1.94 |

Effect of NR Channel Width

Figure 12:
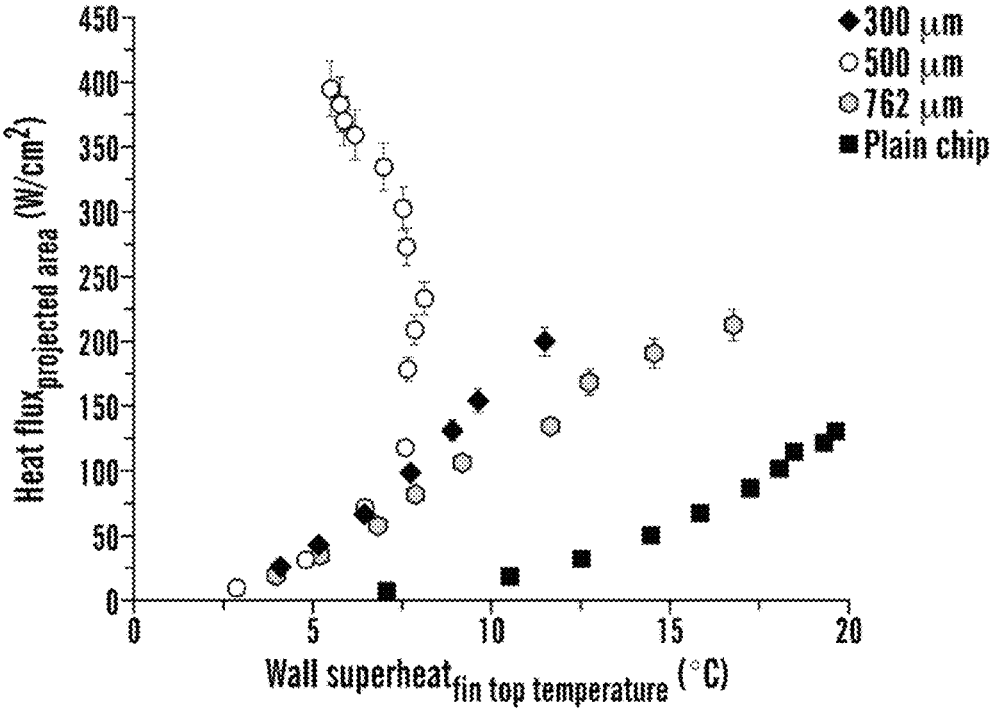
FIG. 12 is a graph showing the effect of nucleation region channel width on the pool boiling performance.

FIG. 12 shows the effect of nucleating region channel width on the pool boiling performance of NRFC-2.1 configuration. Since this configuration offered the highest CHF, the effect of nucleating region width and feeder channel width were studied on this geometry. Three channel widths—300 μm, 500 μm, 762 μm were chosen based on the ranges reported in literature. The 300 μm, 500 μm, 762 μm NR channel width surfaces had a CHF of 199 W/cm2, 394 W/cm$^2$ and 212 W/cm$^2$, respectively. The 500 μm channel width surface is borrowed from the previous test matrix to facilitate better understanding of the trend. The main observation in this plot is that an optimal NR channel width exists for an NRFC-2.1 heat exchanger. A drastic reduction in CHF is observed for a narrow (300 μm) and a wide (762 μm). The HTC at CHF for the 300 μm, 500 μm and 762 μm NR channel widths were 173 kW/m$^{2}$° C., 713 kW/m$^{2}$° C. and 126 kW/m$^{2}$° C., respectively. This further reinstates that the performance of NRPC is influenced by the channel dimensions which affects the relative merits of the liquid and vapor transport in fundamentally different ways.

FIG. 12 shows boiling curves for plain and NRFC with three NR channel widths—300 μm, 500 μm, and 762 μm with water at atmospheric pressure with fin top temperature.

In further analyzing the trend, Kandlikar reported a CHF of 300 W/cm2 using a channel width of 500 μm in a contoured fin microstructure. The motion of the bubble on the contoured fin surface was governed by EMF. This is indicative that using a 500 μm channel width with distilled water as the working fluid seems to amplify the performance better than other channel dimensions in the tested range for water. However it is expected that the working fluid will determine the optimal channel width.

Effect of Feeder Channel Width

Figure 13:
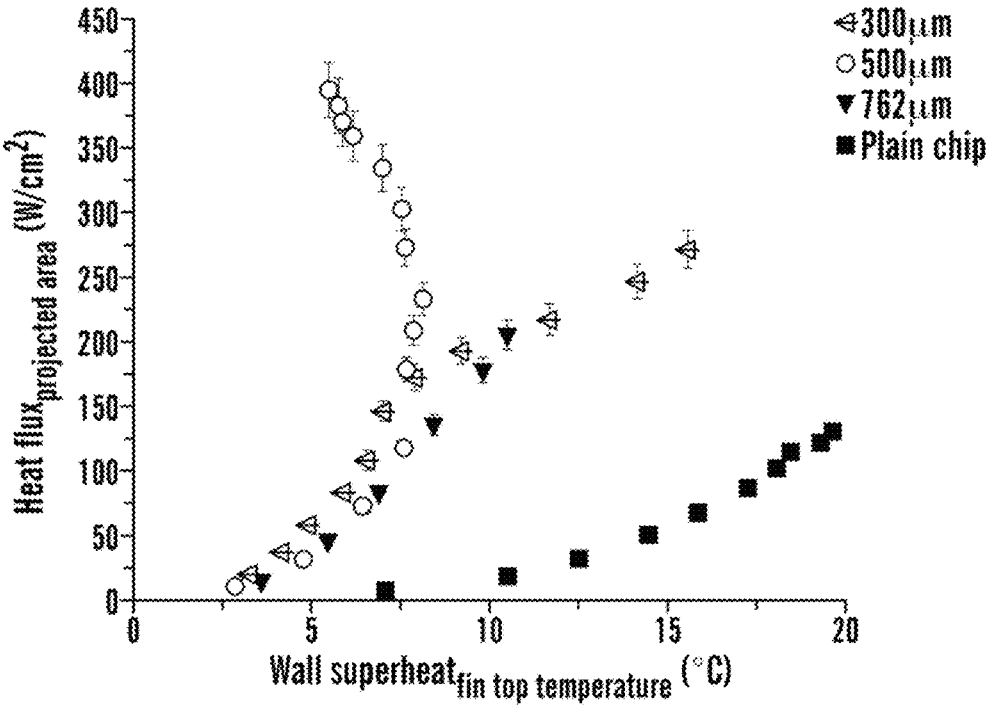
FIG. 13 is a graph showing the effect of feeder channel width on the pool boiling performance.

The effect of feeder channel width was also investigated in this study and is shown in FIG. 13. Similar to the width range selected in the previous section, three channel widths (300 μm, 500 μm and 762 μm) Were chosen to determine the performance. The 300 μm, 500 μm, 762 μm, feeder channel width surfaces had a CHF of 270 W/cm$^2$, 394 W/cm$^2$ and 205 W/cm$^2$, respectively. The corresponding HTCs at CHF for the three surfaces were 173 kW/m$^{2}$° C., 713 kW/m2° C. and 194 kW/m2° C. respectively. A similar trend in CHF is observed here were a narrow (300 μm) and wide channel (762 μm) show a reduction in performance compared to a 50 μm feeder channel width surface.

FIG. 13 shows boiling curves for plain and NRFC with three FC channel widths—300 μm, 500 μm and 762 μm with water at atmospheric pressure with tin top temperature.

Comparison with Literature

Figure 14:
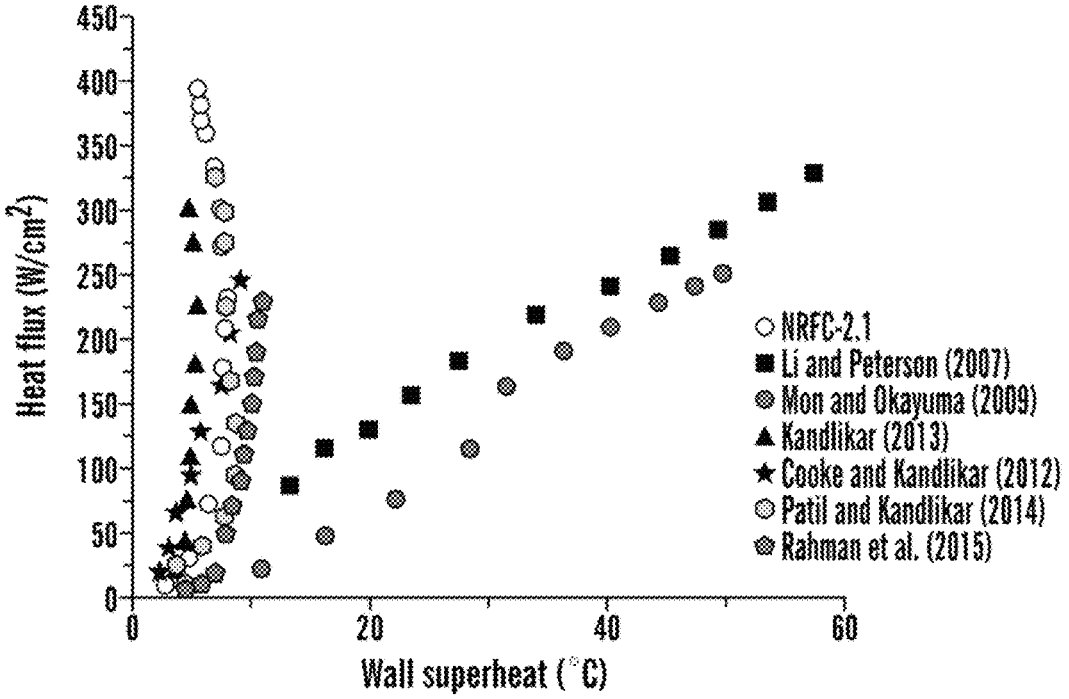
FIG. 14 is a graph showing the comparison of pool boiling curves obtained with different microstructure enhancements.

FIG. 14 shows the comparison between the best performing surface reported in this study (chip 3) and performance plots available in literature for other enhancement techniques. The CHF of the chip reported in this study is higher than all values presented in the comparison. For example, Patil and Kandlikar reported a CHF value of 325 W/cm$^2$ at a wall superheat of 7.3° C. At a wall superheat of 5.5° C. a higher CHF (394 W/cm$^2$) is observed for NRFC-2.1. This surface also had a higher CHF compared to Kandlikar, however the wall superheat was slightly increased. The NRFC can be looked at as an enhancement over open microchannels which has shown stark improvement in providing higher CHF at lower wall superheats. Furthermore, CHF reported by Mori and Okayuma and Li and Peterson are in the range of 250 W/cm$^2$ and 325 W/cm$^2$ respectively but at very high wall superheats, in excess of 50° C., which is undesirable. The wall superheats for all surfaces investigated in this study are in the range of 5.5° C. to 15° C. A recently reported enhancement structure involving bi-conductive heat exchange region is also compared. This chip reached a CHF of 228 W/cm$^2$ with a corresponding HTC of 210 kW/m$^{2\circ}$ C.

FIG. 14 shows a comparison of best performing chip with other enhancements available in literature using fin top temperature.

Figure 15:
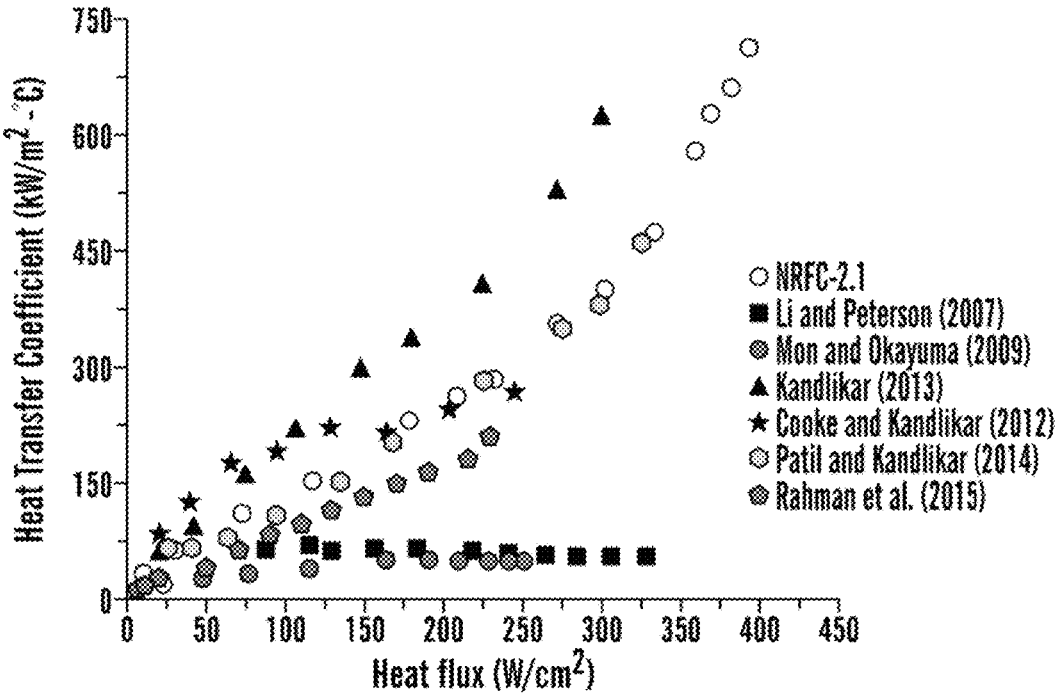
FIG. 15 is a graph showing the comparison of heat transfer performance obtained with different microstructure enhancements.

FIG. 15 shows a comparison of heat transfer performance with other enhancement techniques available in literature.

Figure 16:
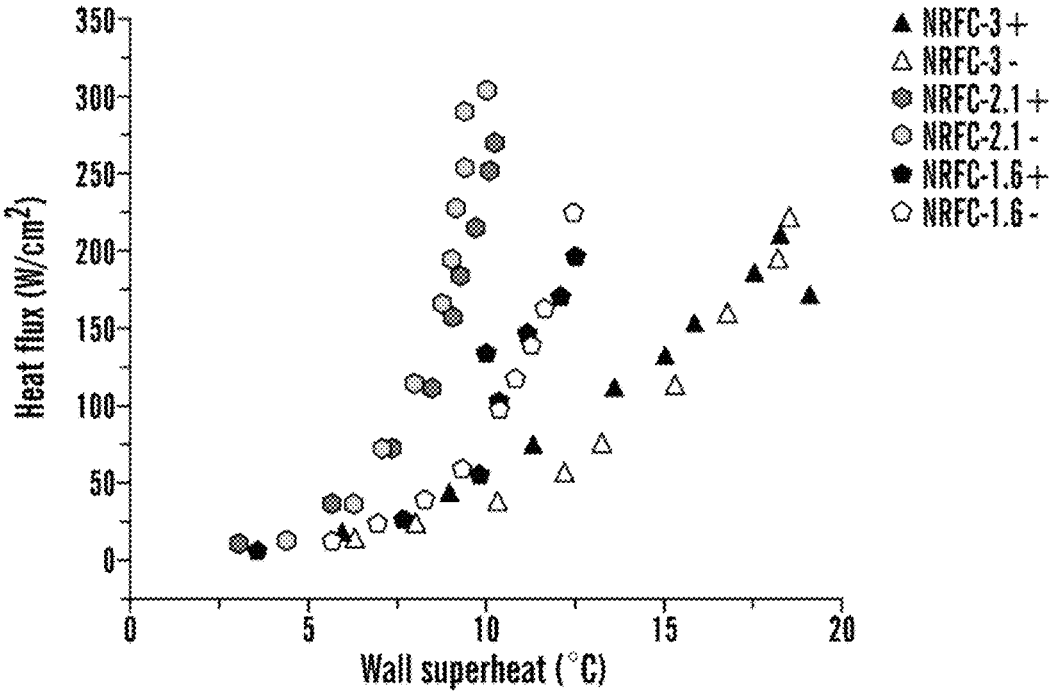
FIG. 16 is a graph showing the hysteresis curves for NRFC-3, 2.1 and 1.6.

Hysteresis Study:

A hysteresis study was performed to understand any losses that may occur during the cool down cycle. FIG. 16 shows the heating and cooling nucleate boiling curves for NRFC-3, 2.1 and 1.6. Firstly, NRFC-3 and 1.6 were pushed to a heat flux of around 230 W/cm2 and subjected to reducing heat flux to observe any deviation in the two curves. This was done because of the design of the experimental setup used in this study. Upon reaching CHF, the setup demands that the contact between the copper heater block and test chip be removed to prevent thermal damage of the components associated. In order to safeguard the setup, hysteresis study was conducted by pushing the chip to around 80-90% of the CHF value which was determined in the first test run. All the curves indicate minimal heat loss (hysteresis) ensuring repeatability at different surface temperatures within experimental errors discussed previously in the uncertainty analysis.

FIG. 16 illustrates a heat transfer study to analyze hysteresis for 2, 3 and 4 nucleating channels.

Figure 17:
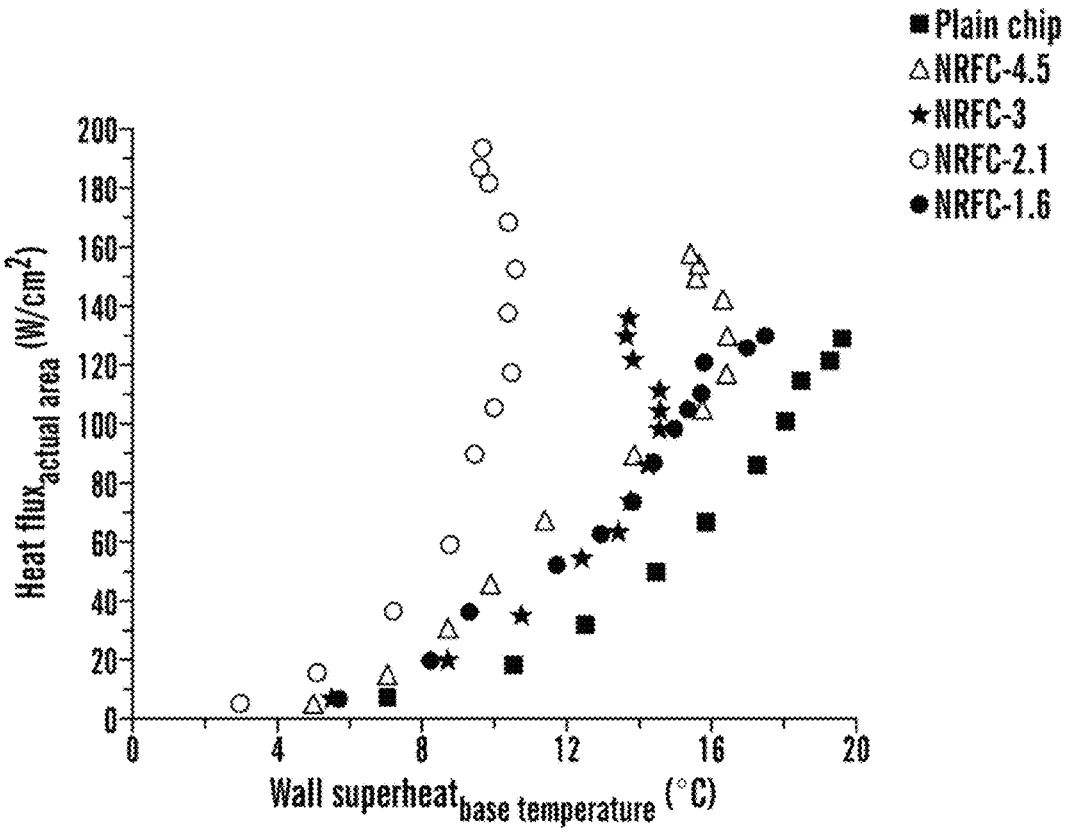
FIG. 17 is a graph showing the normalized pool boiling curves for NRFC-4.5, NRFC-3, NRFC-2.1 and NRFC-1.6.
Figure 18A:
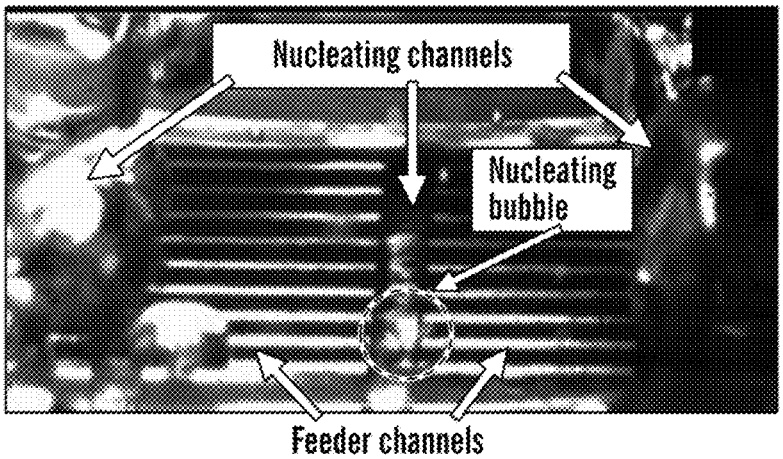
FIG. 18 is a series images showing the bubble sequence from nucleation departure for NRFC-2.1 configuration.
Figure 18B:
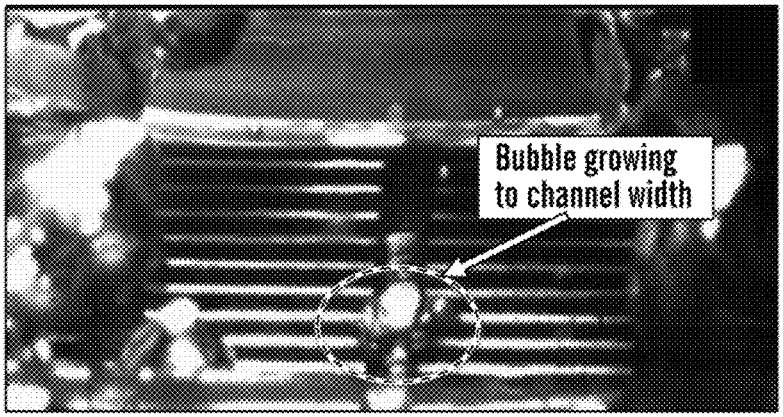
Figure 18C:
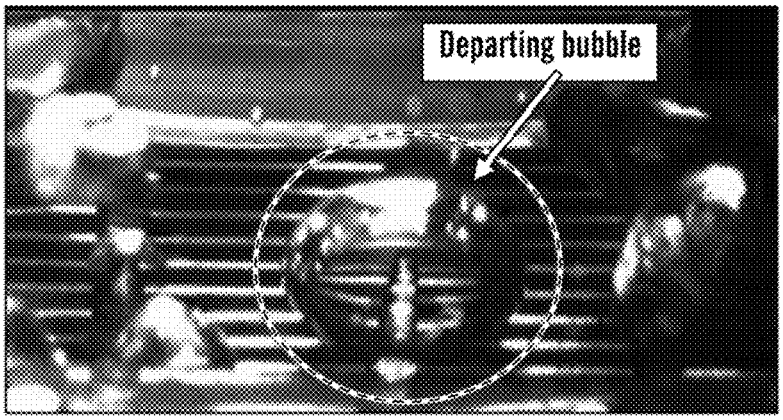
Figure 18D:
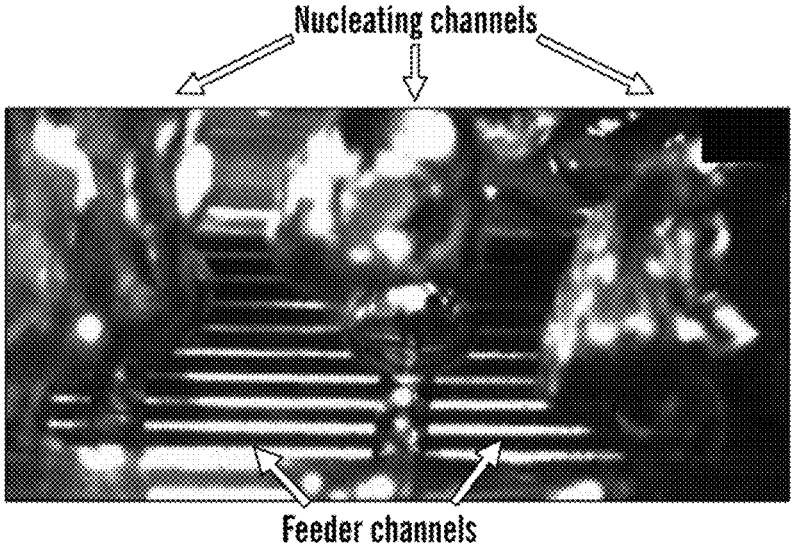
Figure 18E:
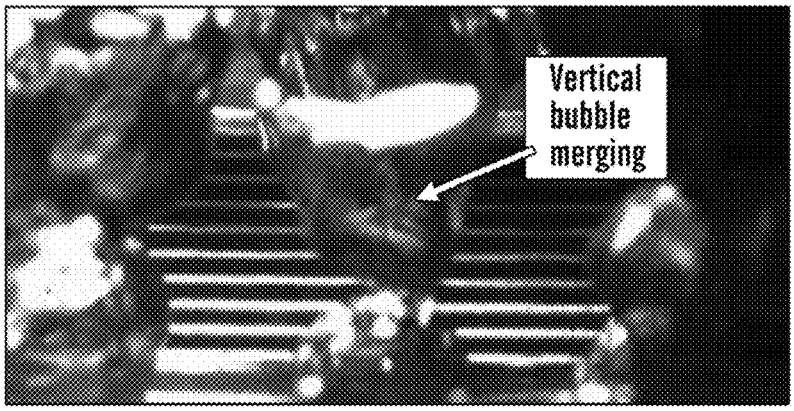
Figure 18F:
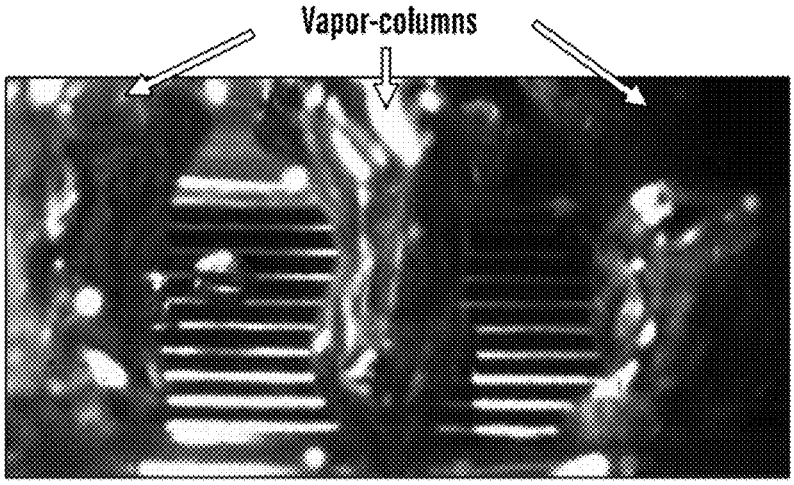

Normalized Curves:

FIG. 17 illustrates normalized pool boiling curves to show area enhancement of nucleating channels microchannel surfaces using base temperature.

Table 2 shows the surface area enhancement factor for each NRFC configuration used in this study. The contributing factors to the area enhancements are number of channels, channel width, fin width and channel depth. The heat fluxes for the surfaces under investigation are divided by their respective area enhancement factors neglecting fin efficiency. The base temperature of the surface is considered while reporting wall superheat as shown in FIG. 17. NRFC-2.1 had a CHF of 193 W/cm$^2$ at a wall superheat of 9.8° C. which resulted in an enhancement of 56% in CHF over a plain surface.

Discussion

High speed images were taken to facilitate detailed understanding of the underlying mechanisms. Bubbles were formed at the corner regions (intersections of feeder channels and nucleating channels) on the bottom of channels and departed from the top of the fins which induced liquid inflow into the channels which was the chief contributor to low wall superheats and delayed CHF. Feeder channels provided better irrigation pathways to the nucleating region channels setting up the convective flow aiding in liquid re-wetting in the channels.

Visualization Images:

The architecture of the surface was such the feeder channels were able to continuously supply liquid to the nucleating channel regions. The liquid supply was heavily influenced by the feeder channel bank width. High speed images were obtained using a Photron fastcam at a high frame rate of 4000 fps.

The bubble nucleation and departure sequence is shown in FIG. 18(*a-c*) for NRFC-3. The bubbles are seen to nucleate in the nucleating channel region before it grows to the channel width and finally departs from the tin tops of feeder channels. FIG. 18(*d*) identifies additional nucleation sites that become active inside the nucleating channels. FIG. 18(*e*) shows the coalescence of bubbles in the vertical direction. FIG. 18(*f*) distinctly shows separate liquid-vapor pathways. Vapor columns are observed over the nucleating channel region with subsequent liquid addition through the feeder channel regions. In the videos captured, some bubbles were seen to nucleate inside the feeder channels. However, these bubbles are proposed to create reverse pathways in the liquid due to the increased agitation, improving the heat transfer in the region.

FIG. 18. Bubble sequence obtained with NRFC-3 surface. (a) A bubble nucleates inside the nucleating channel region (b) Bubble growing to channel width (c) Bubble departing from the fin tops of the feeder channels (d) Additional nucleation sites become active in the nucleating channel (e) Bubbles coalesce in the vertical direction (f) Distinct vapor columns in the nucleating channels and liquid supply pathways through the channel regions.

Figure 19:
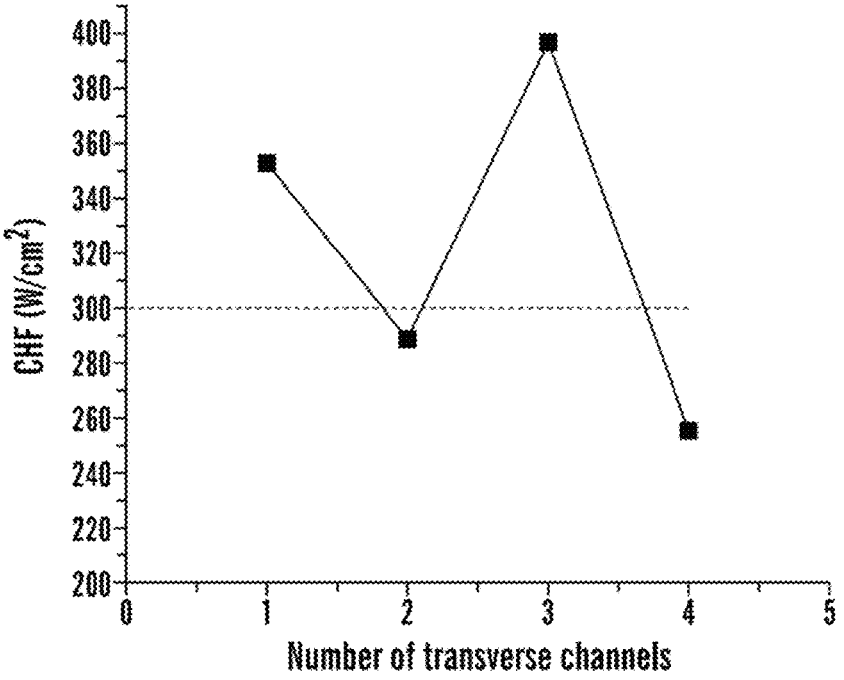
FIG. 19 is a graph of the CHF trend obtained using NRFC configurations.

CHF Trend:

A definite trend in. CHF is observed from the test surfaces investigated in this study. FIG. 19 shows a plot of CHF versus pitch of nucleating channels. As mentioned previously, the bubble departure diameter obtained from Fritz equation resulted in a value of 2.12 mm and NRFC-2.1 and NRFC-4.5 have bank widths that are 1 and 2 integer multiples of the bubble departure diameter suggesting a trend in CHF as reported here. These values indicate that bank widths that are multiples of the bubble diameter enhance the pool boiling performance better than hank widths that are not multiples.

FIG. 19 illustrates the CHF trend in nucleating channels microchannel showing odd number of channels performing better than even number of channels.

Results—Pool Boiling with FC-87

The temperature limit (85° C.) imposed for electronics cooling inhibits the use of water as a potential cooling fluid in these devices. Instead fluorinert series fluids and refrigerants are suitable liquids due to their lower saturation temperatures. In this study, pool boiling tests of nucleating channels surfaces with FC-87 at atmospheric conditions is conducted.

Figure 20:
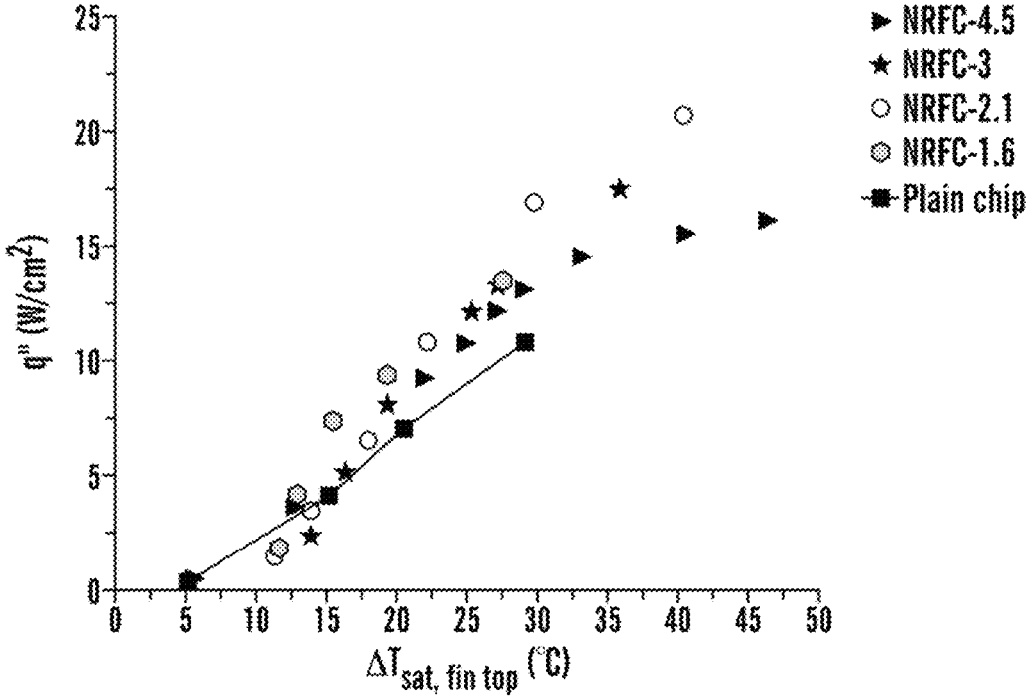
FIG. 20 is a graph showing the pool boiling; tests with FC-87 for NRFC-4.5, NRFC-3, NRFC-2.1 and NRFC-1.6.

Pool boiling tests with DC-87 is performed with the test setup designed and fabricated by Kalani and Kandlikar. FIG. 20 shows the pool boiling curve for nucleating channels microchannels with PC-87 at atmospheric pressure. Firstly, FC-87 is allowed to boil on a plain chip which is prepared by rubbing on 2000 grit sandpaper. A CHF of 10 W/cm$^2$ is observed and this will serve as baseline comparison for all enhancements reported in this study. A CHF of 16 W/cm$^2$, 17 W/cm$^2$, 20 W/cm$^2$ and 13 W/cm$^2$ is reported for NRFC-4.5, NRFC-3, NRFC-2.1, and NRFC-1.6, respectively. Large wall superheats are expected due to the poor thermal properties of fluorinert fluids. The wall superheats are 30° C., 46° C. 35° C., 40° C. and 27° C. for plain, NRFC-4.5, NRFC-3, NRFC-2.1 and NRFC-1.6 respectively. The nucleating channels chips show minimal enhancement at lower heat fluxes compared to a plain chip whereas at higher heat flux this enhancement is more pronounced. All tested chips follow similar pool boiling pattern in which natural convection is dominant in the initial phase till the onset of nucleate boiling where more nucleation sites become available which are responsible for increased heat dissipation rates. The experiments were stopped once CHF is attained which is seen by a sudden spike in the surface temperature indicating existence of a thin vapor blanket on the surface inhibiting heat transfer.

Figure 21:
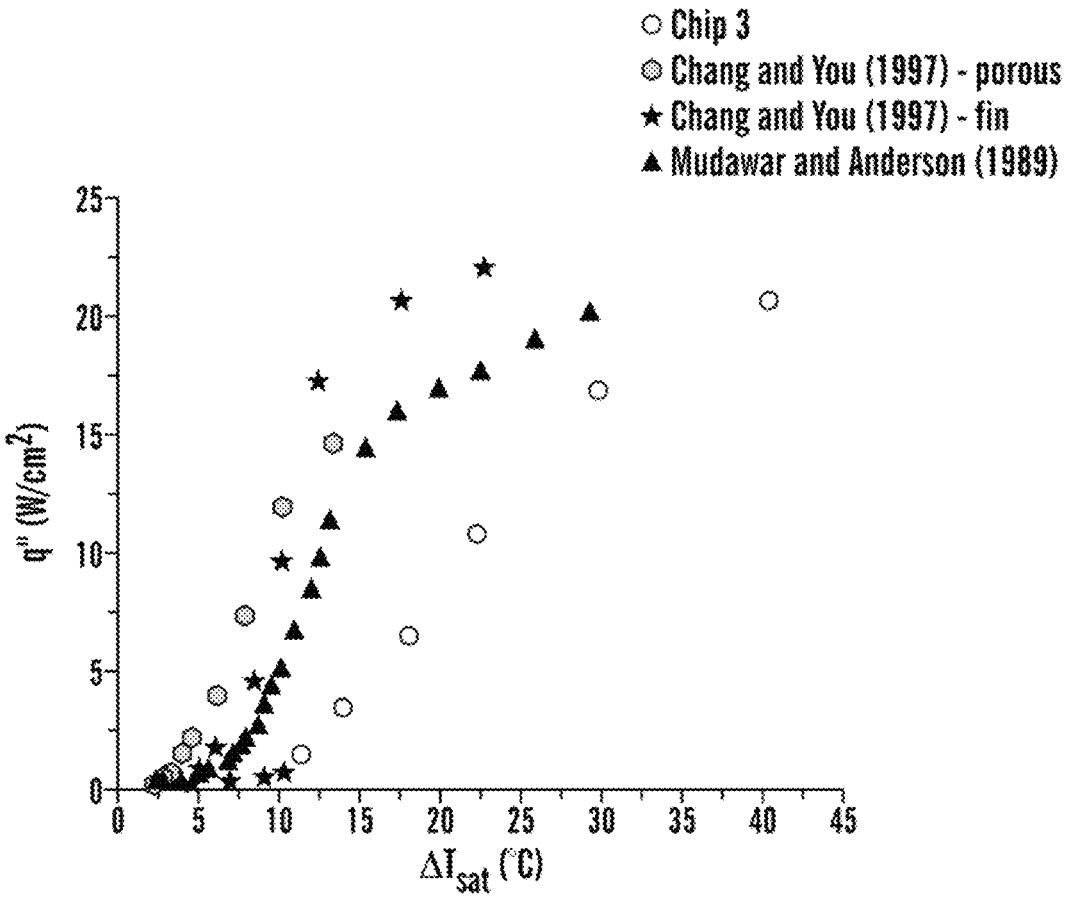
FIG. 21 is a graph showing the comparison of pool boiling curves with FC-87.

FIG. 21 shows pool boiling test results with FC-87 at atmospheric pressure.

Comparison to Literature

FIG. 21 shows pool boiling performance comparison with similar enhancements available in literature.

FIG. 21 shows the pool boiling comparison with similar enhancement techniques available in literature. NRFC-2.1 under performs when compared to other enhancement techniques reported here. However, the enhancement techniques correspond to tall fins in the order of 2 mm or more. It has been established in literature that tall fins, due to additional surface area have shown significant enhancement. This study aims to improve the heat transfer performance with low fins in the order of 400 μm. At CHF, the best performing chip has a CHF of 21 W/cm$^2$ which is higher than that reported by Mudawar and Anderson and Chang and You. Due to poor thermal properties of FC-87 high wall superheats are expected which is consistent with all the curves reported in this study.

Validation of Mechanism

High speed images were inhibited by the design of the experimental setup used in this study. A similar trend is observed in CHF values when compared to water. The Fritz equation does not hold good for FC 87 as the effect of fluid flow resistance in the channels have to be accounted for highly wetting fluids like FC-87. Experimental determination of bubble departure diameter is suggested with FC-87.

Additional Comments

The spacing between the nucleating channels were derived from the departure bubble diameter information using Fritz equation. However, this is used as a guidance. The optimum spacing may be different because of deviations in departure bubble diameter due to effects arising from localized geometry, conditions and heat flux levels. An optimum spacing for specific heater surface and fluid may be obtained through experiments.

The NR channels shown here were normal to the microchannels. The microchannel shape, size and profile may be different from what is shown here. Also, the nucleating channels may be of different widths, and at different angles than 90 degrees. The microchannels and the nucleating channels may be not be straight as shown and may be curved or geometrically patterned such as square patterned microchannels with nucleating channels in square pattern or circular pattern, etc.

Although various embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A boiling heat transfer unit comprising a substrate having a heat exchange region comprising a plurality of nucleating regions, each having a channel length and intersecting with open feeder channels having a length along the substrate surface, wherein the intersecting nucleating regions are disposed in a manner at the ends of the length of the feeder channels at a distance whereby vapor formed in the nucleating regions is moved away from the nucleating regions influencing liquid flow through the length of the feeder channels towards the nucleating regions suppressing nucleation along the length of the feeder channels and establishing continuous self-sustaining spatial ordering of separate vapor and liquid pathways increasing heat transfer due to developing region heat transfer in the feeder channels and enhancing overall boiling performance.

2. The boiling heat transfer unit of claim 1, wherein adjacent nucleating regions are separated by the feeder channels at a distance of between about 1 mm to about 10 mm.

3. The boiling heat transfer unit of claim 1, wherein the width of the nucleating region is a distance within a range from about 5 μm to about 4 mm.

4. The boiling heat transfer unit of claim 1, wherein the width of the feeder channel is a distance within a range from about 5 μm to about 4 mm.

5. The boiling heat transfer unit of claim 1, wherein the depth of the feeder channel is from above 0 mm to about 10 mm.

6. The boiling heat transfer unit of claim 1, wherein the adjacent nucleating regions are separated by the feeder channels at a distance of between about 50 percent to about 200 percent of an estimation of the departure bubble diameter.

* * * * *